US010040595B2

(12) United States Patent
Jiang et al.

(10) Patent No.: US 10,040,595 B2
(45) Date of Patent: Aug. 7, 2018

(54) PACKING BOX FOR PACKING TUBE LAMPS

(71) Applicant: JIAXING SUPER LIGHTING ELECTRIC APPLIANCE CO., LTD, Zhejiang (CN)

(72) Inventors: Tao Jiang, Zhejiang (CN); Shau-Liang Chen, Zhejiang (CN)

(73) Assignee: JIAXING SUPER LIGHTING ELECTRIC APPLIANCE CO., LTD, Zhejiang (CN)

( * ) Notice: Subject to any disclaimer, the term of this patent is extended or adjusted under 35 U.S.C. 154(b) by 56 days.

(21) Appl. No.: 15/196,955

(22) Filed: Jun. 29, 2016

(65) Prior Publication Data

US 2017/0001793 A1 Jan. 5, 2017

(30) Foreign Application Priority Data

Jun. 30, 2015 (CN) ..... 2015 2 0476671
Oct. 2, 2015 (CN) ..... 2015 1 0641990
Jan. 4, 2016 (CN) ..... 2016 1 0004511

(51) Int. Cl.

| | |
|---|---|
| ***B65D 5/04*** | (2006.01) |
| ***B65D 85/20*** | (2006.01) |
| ***B65D 5/00*** | (2006.01) |
| ***B65D 77/04*** | (2006.01) |
| ***B65D 5/02*** | (2006.01) |
| ***B65D 85/42*** | (2006.01) |

(52) U.S. Cl.

CPC ..... *B65D 5/04* (2013.01); *B65D 5/029* (2013.01); *B65D 77/042* (2013.01); *B65D 85/42* (2013.01)

(58) Field of Classification Search

CPC ..... B65D 5/04; B65D 5/029; B65D 77/042; B65D 85/42

USPC .... 206/420, 419, 418, 434, 504; 229/89, 90; 220/507, 529, 510

See application file for complete search history.

(56) References Cited

U.S. PATENT DOCUMENTS 1,423,272 A * 7/1922 Steudel ..... B65D 5/04 229/101
2,892,581 A * 6/1959 Amatel ..... B65D 5/48014 206/422
2,940,653 A * 6/1960 Miessler, Sr. ..... B65D 5/5016 206/422

(Continued)

FOREIGN PATENT DOCUMENTS

CN 204802382 U 11/2015

*Primary Examiner* — Chun Cheung
(74) *Attorney, Agent, or Firm* — Andrew M. Calderon; Roberts Mlotkowski Safran Cole & Calderon, P.C.

(57) ABSTRACT

A packing box for packing tube lamps is provided. The packing box includes a middle case. The middle case is for packing two or more tube lamps. The middle case includes a support section and two bent sections at two opposite sides of the support section. The two bent sections are bent towards the support section. The support section and the two bent sections are substantially aligned in a width direction of the tube lamps before the bent sections are bent. The support section and each of the two bent sections respectively form one or more receiving cavities each of which is for receiving one of the tube lamps and are for wrapping the two or more tube lamps after the bent sections are bent. The tube lamps are easily packed by the packing box, and the tube lamps in the packing box are not easily damaged.

31 Claims, 24 Drawing Sheets

(56) References Cited

U.S. PATENT DOCUMENTS

| | | | | |
|---|---|---|---|---|
| 4,834,239 | A | 5/1989 | Osgood | |
| 4,989,779 | A * | 2/1991 | Lashyro | B65D 5/48014 206/140 |
| 5,458,271 | A * | 10/1995 | Allen | B65D 5/48 211/72 |
| 5,730,289 | A * | 3/1998 | Cappels | B65D 5/4804 206/418 |
| 5,826,722 | A | 10/1998 | Phillips | |
| 6,877,606 | B2 * | 4/2005 | Hardy | B65D 71/46 206/419 |
| 2007/0068950 | A1 | 3/2007 | Hine et al. | |

* cited by examiner (a)

(b)

(a)

(b)

(a)

(b)

(a)

(b)

PACKING BOX FOR PACKING TUBE LAMPS

CROSS-REFERENCE TO RELATED APPLICATIONS

This application claims priority of Chinese Patent Application no. CN201520476671.5 filed on 2015 Jun. 30, Chinese Patent Application no. CN201510641990.1 filed on 2015 Oct. 2, and Chinese Patent Application no. CN201610004511.X filed on 2016 Jan. 4, the disclosures of which are incorporated herein in their entirety by reference.

TECHNICAL FIELD

The instant disclosure relates to a packing box and, more particularly, to a packing box for packing tube lamps.

BACKGROUND OF THE INVENTION

Tube lamps, e.g., fluorescent lamps, are easily broken or scratched. These properties of the tube lamps must be considered with respect to transportation of the tube lamps. Special packages for the tube lamps are required to prevent the tube lamps from being damaged due to collision or squeeze during transportation.

SUMMARY

The tube lamps are easily damaged due to collision, impact, vibration, static pressure, or dynamic pressure during transportation. Special packages are required to protect the tube lamps. However, according to the packages of prior arts, cost of products of the packaged tube lamps as a whole is increased since the process of packing the tube lamps by these special packages consumes a lot of time. Materials of the packages of prior arts cannot be utilized efficiently, either.

To address the above issue, the instant disclosure provides a packing box for packing tube lamps. The packing box comprises a middle case. The middle case is for packing at least two tube lamps. The middle case comprises a support section and two bent sections at two opposite sides of the support section. The two bent sections are bent towards the support section. The support section and the two bent sections are substantially aligned in a width direction of the tube lamps before the bent sections are bent. The support section and each of the two bent sections respectively form at least one receiving cavity for receiving one of the at least two tube lamps and are for wrapping the at least two tube lamps after the bent sections are bent.

According to an embodiment, each of the two bent sections comprises a free end. At least one of the two bent sections are connected to the support section by the free end to form the receiving cavity for receiving the tube lamp and to be utilized for wrapping the tube lamp in a circumferential direction.

According to an embodiment, the two bent sections at two opposite sides of the support section are bent towards the same side of the support section.

According to an embodiment, the shape of a projection of the receiving cavity along a length direction substantially perpendicular to the width direction of the tube lamps is a regular polygon.

According to an embodiment, the middle case further comprises at least one protective structure disposed in the receiving cavity for preventing the tube lamp in the receiving cavity from moving out. The protective structure is for against an end of the tube lamp.

According to an embodiment, the receiving cavity is defined as a receiving part and an extending part in a length direction substantially perpendicular to the width direction of the tube lamps. The receiving part is for receiving the tube lamp, and the protective structure is in the extending part.

According to an embodiment, each of the receiving cavities is formed by a plurality of side walls comprising a first side wall and a second side wall adjacent to each other in a circumferential direction. The protective structure is formed on the first side wall and the second side wall. The protective structure comprises two edges and an inversely bent section. The two edges are spaced from each other in the length direction. Each of the two edges crosses the first side wall and the second side wall in the circumferential direction and is separated from the first side wall and the second side wall. The inversely bent section is between the two edges. The inversely bent section is bent towards the inner side of the receiving cavity.

According to an embodiment, a first bent edge is formed between the first side wall and the second side wall. The inversely bent section comprises two bent surfaces. A second bent edge between the two bent surfaces. Before the inversely bent section is bent, the first bent edge and the second bent edge are substantially aligned in the same straight line or the first bent edge and the second bent edge are spaced from each other in the width direction.

According to an embodiment, the inversely bent section is spaced from an end edge of the extending part away from the receiving part of the receiving cavity.

According to an embodiment, a length of the inversely bent section in the length direction is between 1 cm and 3 cm.

According to an embodiment, one of the two edges of the protective structure overlaps an end edge of the extending part away from the receiving part of the receiving cavity.

According to an embodiment, a length of the extending part of the receiving cavity in the length direction is between 10 cm and 20 cm.

According to an embodiment, the number of the protective structures is two. One of the two protective structures is formed on two adjacent side walls, and the other one of the two protective structures is formed on another two adjacent side walls.

According to an embodiment, the shape of a cross section of the protective structure enclosed by the inversely bent section, the first side wall, and the second side wall in a radial direction of the tube lamp is a tetragon. The area of the cross section of the protective structure in the radial direction is from 1/16 to 9/16 of the area of a cross section of the receiving cavity in the radial direction.

According to an embodiment, each of the receiving cavities is formed by a plurality of side walls, and the middle case further comprises a connecting structure. The connecting structure comprises a male part and a female part. The male part and the female part are respectively on the side walls. The male part is connected to the female part.

According to an embodiment, the male part is on an outer surface of the side wall of one of the receiving cavities, and the female part is on an outer surface of the side wall of another one of the receiving cavities.

According to an embodiment, each of the two bent sections comprises a free end, the male part is on the free end, and the female part is on the support section.

According to an embodiment, the connecting structure is a coupling structure or an adhesive structure.

According to an embodiment, the support section comprises a bent edge along a length direction substantially perpendicular to the width direction of the tube lamps. The support section is capable of being bent about the bent edge.

According to an embodiment, the support section is bent about the bent edge to form two side walls attached to each other and respectively pertaining to two adjacent receiving cavities each of which is formed by a plurality of side walls.

According to an embodiment, the support section is bent about the bent edge to form one side wall shared by two adjacent receiving cavities each of which is formed by a plurality of side walls.

According to an embodiment, the support section is bent about the bent edge to form two side walls respectively pertaining to two adjacent receiving cavities each of which is formed by a plurality of side walls.

According to another embodiment, the packing box comprises a middle case. The middle case is for packing tube lamps. The middle case comprises a support section and two bent sections at two opposite sides of the support section. The two bent sections are bent towards the support section. The support section and the two bent sections are substantially aligned in a width direction of the tube lamps before the bent sections are bent. The support section and each of the two bent sections respectively form a plurality of receiving cavities of which the number is even. Each of the plurality of the receiving cavities is for receiving one of the tube lamps. The support section and each of the two bent sections are for wrapping the tube lamps after the bent sections are bent.

According to another embodiment, the even number of the plurality of the receiving cavities is 2, 4, 8 or 16.

Concisely, the packing boxes of the embodiments of the instant disclosure are designed for packing the tube lamps. The bent sections of the middle case of the packing box are bent to form the receiving cavities. The tube lamp can be tightly fit in the receiving cavity such that the tube lamps in the packing box are not easily damaged due to collision, impact, vibration, static pressure, or dynamic pressure. And the tube lamps are easily packed by the packing box.

The protective structure of the middle case can restrict the movement of the tube lamp so as to prevent the tube lamp from moving out of the receiving cavity.

The connecting structure of the middle case can prevent the bent section from spreading so as to have the receiving cavity fixed. The protection of the tube lamp during the transportation can be guaranteed.

The features of the instant disclosure will no doubt become understandable to those of ordinary skill in the art after reading the following detailed description of the preferred embodiment that is illustrated in the various figures and drawings.

DETAILED DESCRIPTION

Figure 1:
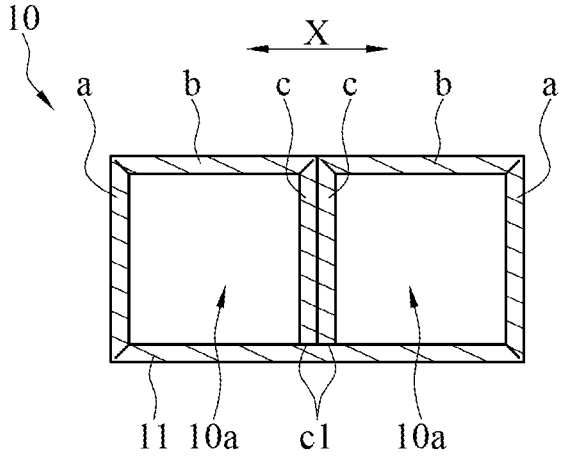
FIG. 1 illustrates cross sections of two examples of middle cases of a packing box according to the first embodiment of the instant disclosure.
Figure 1:
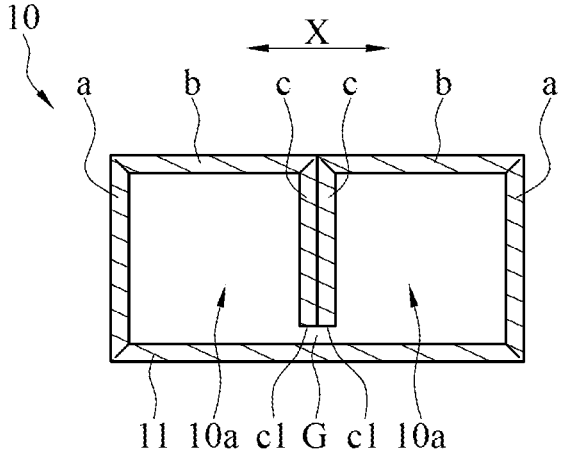

The instant disclosure provides a packing box for packing tube lamps to solve the abovementioned problems. The instant disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

It will be understood that the term "and/or" includes any and all combinations of one or more of the associated listed items. It will also be understood that, although the terms first, second, third etc. may be used herein to describe various elements, components, regions, parts and/or sections, these elements, components, regions, parts and/or sections should not be limited by these terms. These terms are only used to distinguish one element, component, region, part or section from another element, component, region, part or section. Thus, a first element, component, region, part or section discussed below could be termed a second element, component, region, part or section without departing from the teachings of the present disclosure.

The following description with reference to the accompanying drawings is provided to explain the exemplary embodiments of the disclosure. Note that in the case of no conflict, the embodiments of the present disclosure and the features of the embodiments may be arbitrarily combined with each other.

As indicated in the section of the cross-reference, the instant disclosure claims priority of several Chinese patent applications, and the disclosures of which are incorporated herein in their entirety by reference. When it comes to claim construction, the claims, specification, and prosecution history of the instant disclosure controls if any inconsistency between the instant disclosure and the incorporated disclosures exists.

The First Embodiment

Figure 2:
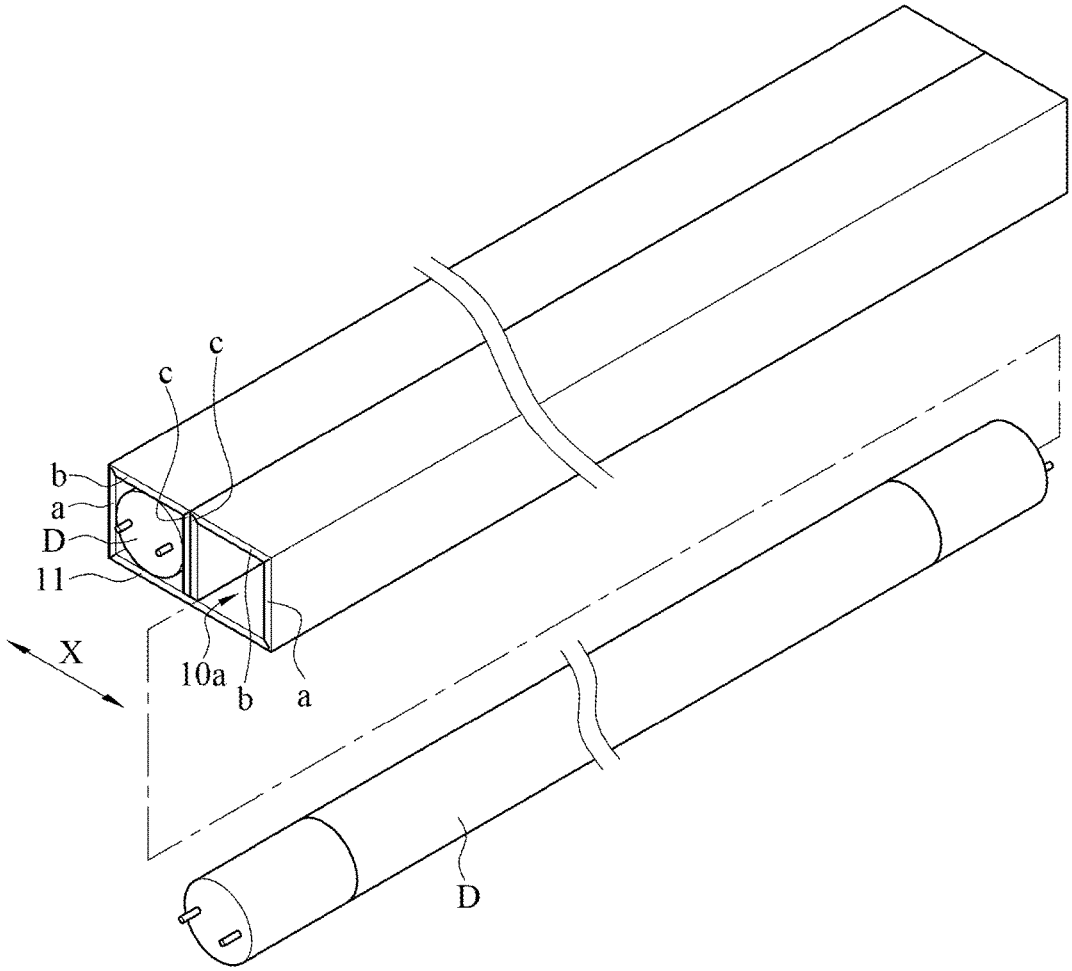
FIG. 2 illustrates diagrams of a middle case of FIG. 1(*a*) with a tube lamp therein.
Figure 2:
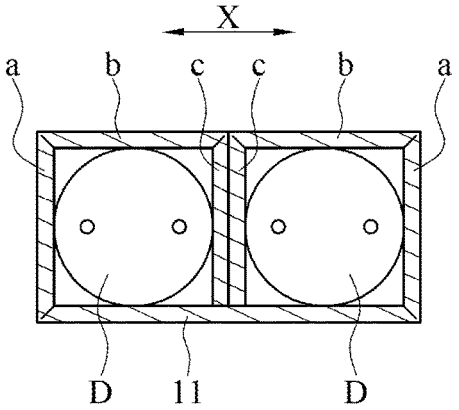

Referring to FIG. 1 and FIG. 2, according to a first embodiment of the instant disclosure, a packing box for packing tube lamps D is disclosed. FIG. 1(*a*) and FIG. 1(*b*) respectively illustrate two examples of middle cases 10 of the packing box. FIG. 1(*a*) and FIG. 1(*b*) are cross sections of the middle cases 10 in a width direction X. FIG. 2(*a*) illustrates a perspective view of the packing box of FIG. 1(*a*) and two tube lamps D packed in the middle case 10 of the packing box. FIG. 2(*b*) illustrates a cross section of the packing box in the width direction X. The packing box comprises a middle case 10. The middle case 10 can be utilized for wrapping at least two tube lamps D. The tube lamp D can be any lamp with tube shape, e.g., fluorescent lamps.

Figure 3:
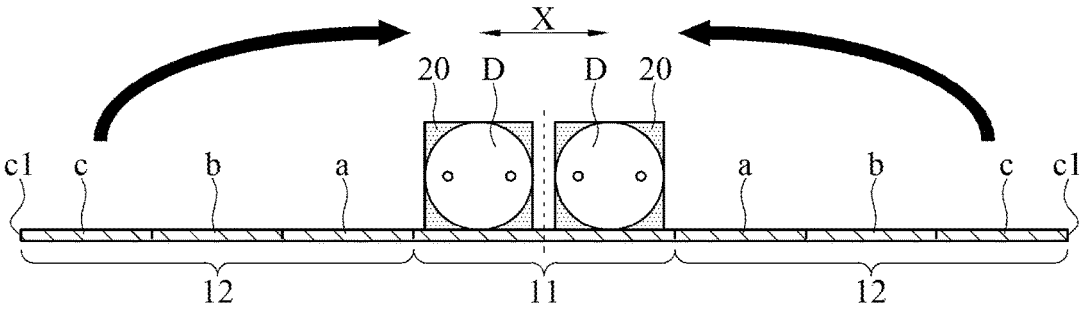
FIG. 3 illustrates a cross section of bent sections going to be bent towards the same side of a support section according to the first embodiment of the instant disclosure.

The middle case 10 is, but is not limited to, made by a piece of cardboard being designed to be bent to wrap the tube lamps D so as to protect the tube lamps D. The material of the middle case 10 is, but is not limited to, a single-layer corrugated paper. As shown in FIG. 3, the packing box further comprises an inner case 20 disposed between the tube lamp D and the middle case 10. In some embodiments, the tube lamp D can be solely received in the middle case 10 without the inner case 20.

Figure 4:
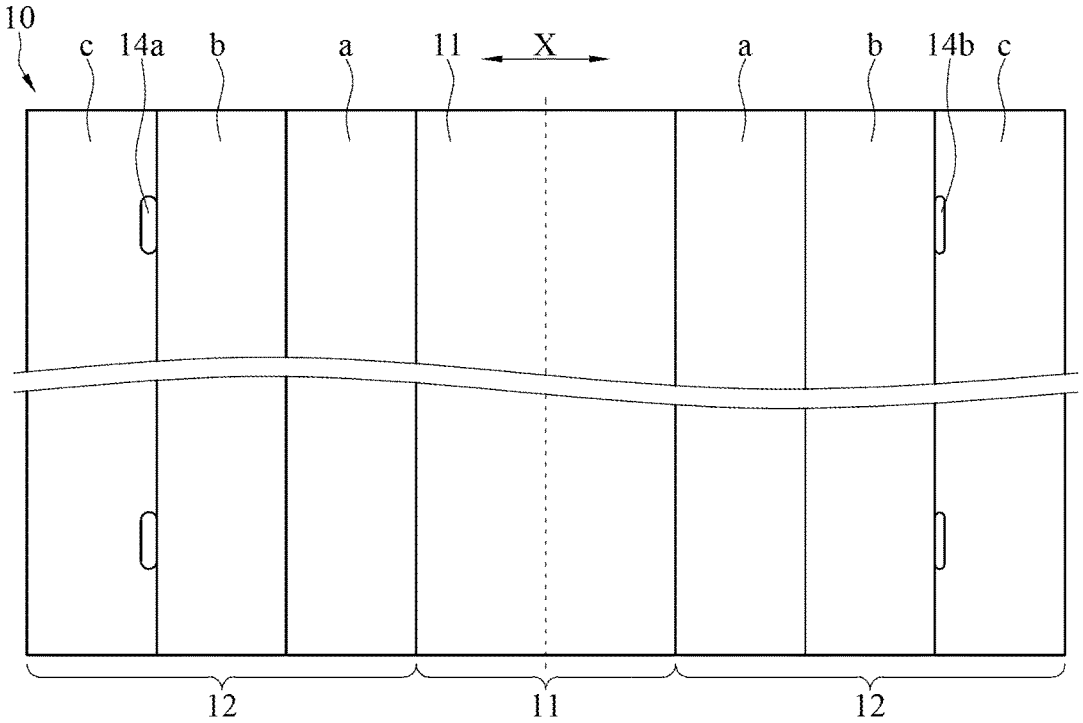
FIG. 4 illustrates top views of two examples of spread middle cases according to the first embodiment of the instant disclosure.
Figure 4:
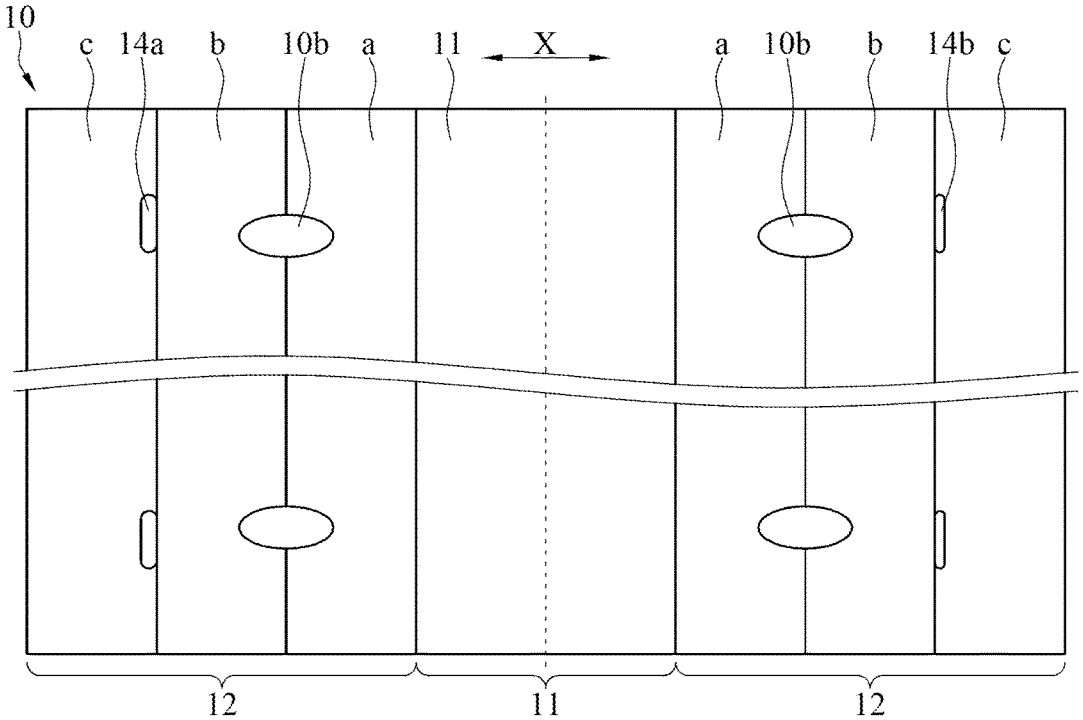

Referring to FIG. 3 and FIG. 4, the middle case 10 comprises a support section 11 and two bent sections 12 which are at two opposite sides of the support section 11. The support section 11 and the two bent sections 12 are substantially aligned in the width direction X. The width direction X is substantially perpendicular to a length direction of the tube lamp D. The two bent sections 12 are bent towards the support section 11. Each of the two bent sections 12 and the support section 11 respectively form at least one receiving cavity 10*a* (shown in FIG. 1) for receiving the tube lamp D. Each of the two bent sections 12 is for wrapping the tube lamp D with the support section 11 in a circumferential direction after each of the bent sections 12 is bent. The tube lamp D can be tightly fit in the receiving cavity 10*a*. In other words, one of the inner cases 20 is for receiving one of the tube lamps D. In some embodiments, one tube lamp D is solely received in one receiving cavity 10*a* without the inner case 20.

Each of the receiving cavities 10*a* is formed by a plurality of side walls. For example, if the shape of a cross section of the receiving cavity 10*a* is a tetragon, the receiving cavity 10*a* is formed by four side walls; if the shape of a cross section of the receiving cavity 10*a* is a triangle, the receiving cavity 10*a* is formed by three side walls. A part of the side walls may pertain to the support section 11, and the other part of the side walls may pertain to the bent section 12. Under the circumstance that the tube lamp D is solely received in the receiving cavity 10*a* without the inner case 20, each of the side walls of the receiving cavity 10*a* contacts a circumferential surface of the tube lamp D such that the tube lamp D is tightly fit in the receiving cavity 10*a*.

Under the circumstance that the tube lamp D is sleeved by the inner case 20, each of the side walls of the receiving cavity 10*a* contacts a circumferential surface of the inner case 20. In the following description of most embodiments of the packing box, each of the side walls of the receiving cavity 10*a* contacts the circumferential surface of the tube lamp D except for some embodiments.

In some embodiments, each of the side walls of the receiving cavity 10*a* does not contact the circumferential surface of the tube lamp D. In that situation, a buffer material (not shown) can be provided between the side walls of the receiving cavity 10*a* and the circumferential surface of the tube lamp D. The buffer material is beneficial to have the tube lamp D tightly fit in the receiving cavity 10*a*. The buffer material can be a bubble wrap, a bubble bag, a foam sheet, a form bag, an Expanded Polyethylene (EPE) bag, or an air column buffer bag.

As shown in FIG. 1 to FIG. 4, the bent section 12 forms a plurality of bent surfaces a, b, and c. At least one of the bent surfaces a, b, and c forms one of the side walls of the receiving cavity 10*a*. In the embodiment, the receiving cavity 10*a* is enclosed and is formed by the bent section 12 and the support section 11. The support section 11 also forms one of the side walls of each of the receiving cavities 10*a*.

In the embodiment, the support section 11 is not bent in the process of forming the receiving cavity 10*a*.

The shape of a projection of the receiving cavity 10*a* along the length direction is a regular polygon, i.e., the shape of the cross section of the receiving cavity 10*a* in a radial direction is a regular polygon. The number of straight sides of the regular cavity 10*a* is natural number which is equal to or greater than 3. In the embodiment, the regular polygon is, for example, a regular tetragon. As shown in FIG. 1 to FIG. 4, the bent section 12 forms three bent surfaces a, b, and c. Three of four straight sides of the regular tetragon of the cross section of the receiving cavity 10*a* respectively locate at (pertain to) the three bent surfaces a, b, and c, and the other one of the four straight sides of the regular tetragon of the cross section of the receiving cavity 10*a* locates at (pertains to) the support section 11. Since the two opposite sides of the support section 11 are respectively provided with the bent section 12 in the width direction X, enclosure of each of the bent sections 12 and the support section 11 forms one receiving cavity 10*a* after the bent sections 12 are bent towards the support section 11. The support section 11 is divided into two parts in the width direction X based on a central line (the dotted line shown in FIGS. 3 and 4). Each of the two parts of the support section 11 respectively forms one of the side walls of each of the two receiving cavity 10*a*. The definition of the regular polygon is that the difference of lengths between the straight sides of the regular polygon is less than 10% of the length of any one of the straight sides.

As shown in FIG. 2, the four straight sides of the regular tetragon of the cross section of the receiving cavity 10*a* contact the circumferential surface of the tube lamp D while the tube lamp D is received in the receiving cavity 10*a*. The length of each of the straight sides of the regular tetragon of the cross section of the receiving cavity 10*a* is substantially equal to the diameter of the tube lamp D, which means that the difference of lengths between each of the straight sides and the diameter of the tube lamp D is less than 20% of the length of any of the straight sides.

Figure 5:
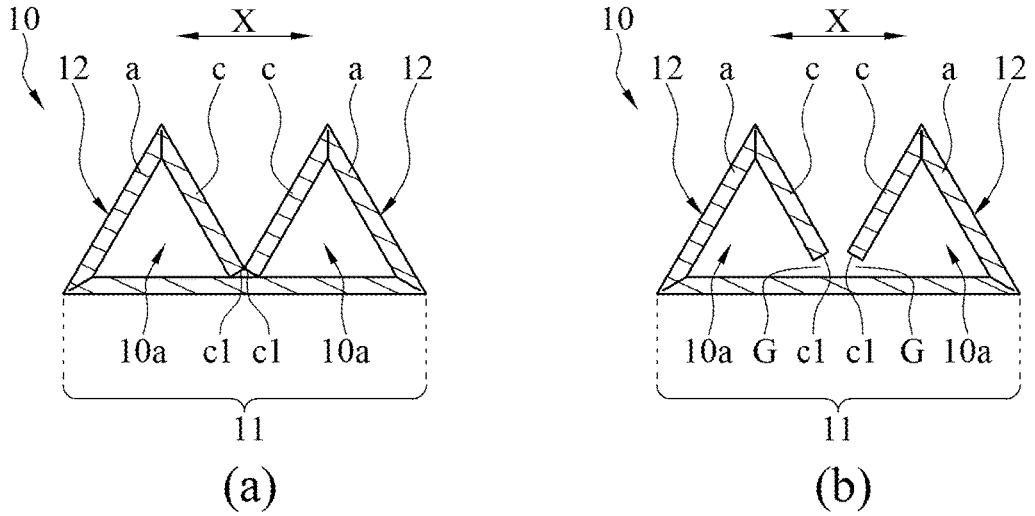
FIG. 5 illustrates cross sections of two examples of middle cases of which the shape of a cross section of each of receiving cavities is a regular triangle according to the first embodiment of the instant disclosure.
Figure 6:
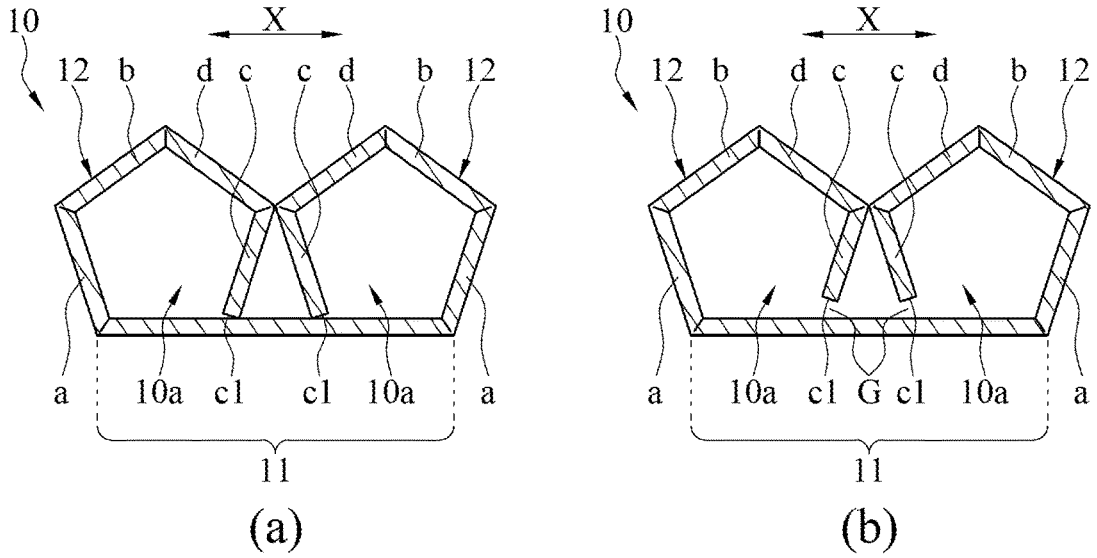
FIG. 6 illustrates cross sections of two examples of middle cases of which the shape of a cross section of each of receiving cavities is a regular pentagon according to the first embodiment of the instant disclosure.
Figure 7:
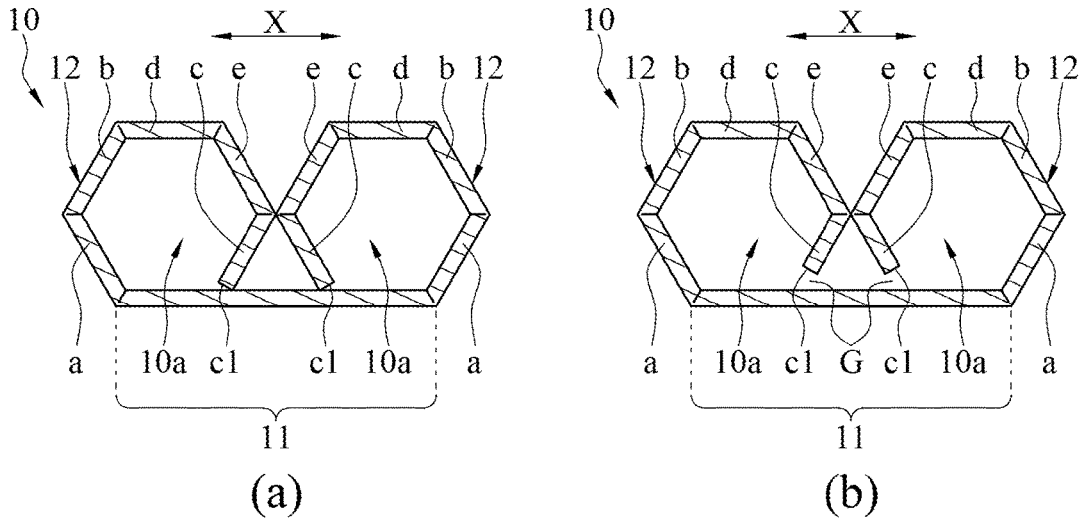
FIG. 7 illustrates cross sections of two examples of middle cases of which the shape of a cross section of each of receiving cavities is a regular hexagon according to the first embodiment of the instant disclosure.
Figure 8:
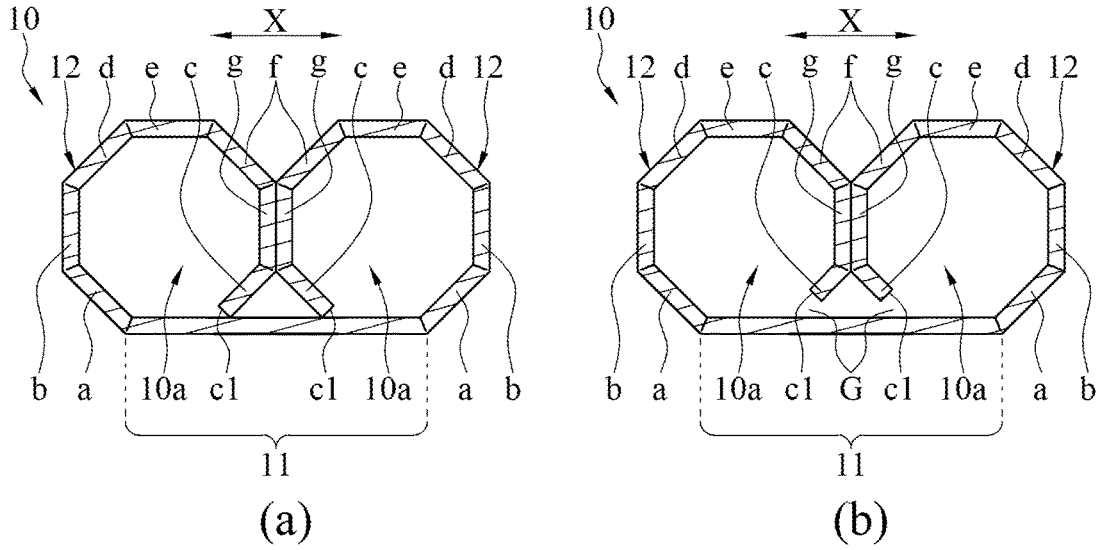
FIG. 8 illustrates cross sections of two examples of middle cases of which the shape of a cross section of each of receiving cavities is a regular octagon according to the first embodiment of the instant disclosure.

In some embodiment, the cross section of the receiving cavity 10*a* can be any shape of a regular polygon such as a regular triangle, a regular pentagon, a regular hexagon, or a regular octagon. As shown in FIG. 5(*a*), the cross section of the receiving cavity 10*a* is a regular triangle, and, consequently, the bent section 12 forms two bent surfaces a and c after being bent. Three straight sides of the regular triangle of the cross section of the receiving cavity 10*a* contact the circumferential surface of the tube lamp D while the tube lamp D is received in the receiving cavity 10*a*. The length of each of the straight sides of the regular triangle of the cross section of the receiving cavity 10*a* is greater than the diameter of the tube lamp D. As shown in FIG. 6(*a*), the cross section of the receiving cavity 10*a* is a regular pentagon, and, consequently, the bent section 12 forms four bent surfaces a, b, c, and d after being bent. Each of the straight sides of the regular pentagon of the cross section of the receiving cavity 10*a* contacts the circumferential surface of the tube lamp D while the tube lamp D is received in the receiving cavity 10*a*. The length of each of the straight sides of the regular pentagon of the cross section of the receiving cavity 10*a* is less than the diameter of the tube lamp D. As shown in FIG. 7(*a*), the cross section of the receiving cavity 10*a* is a regular hexagon, and, consequently, the bent section 12 forms five bent surfaces a, b, c, d, and e after being bent. Each of the straight sides of the regular hexagon of the cross section of the receiving cavity 10*a* contacts the circumferential surface of the tube lamp D while the tube lamp D is received in the receiving cavity 10*a*. The length of each of the straight sides of the regular hexagon of the cross section of the receiving cavity 10*a* is less than the diameter of the tube lamp D. As shown in FIG. 8(*a*), the cross section of the receiving cavity 10*a* is a regular octagon, and, consequently, the bent section 12 forms seven bent surfaces a, b, c, d, e, f, and g after being bent. Each of the straight sides of the regular octagon of the cross section of the receiving cavity 10*a* contacts the circumferential surface of the tube lamp D while the tube lamp D is received in the receiving cavity 10*a*. The length of each of the straight sides of the regular octagon of the cross section of the receiving cavity 10*a* is less than the diameter of the tube lamp D. According to the aforementioned embodiments, after the bent sections 12 are bent and the receiving cavities 10*a* are formed, the difference between the number of straight sides of the polygon of the cross section of the receiving cavity 10*a* and the number of bent surfaces that the bent section 12 forms is 1.

Analogously, the cross section of the receiving cavity 10*a*, i.e., the shape of a projection of the receiving cavity 10*a* along the length direction, can be any shape of a regular polygon except for the aforementioned examples. The correlation between the length of each of the straight sides of the regular polygon of the cross section of the receiving cavity 10*a* and the diameter of the tube lamp D is described below. The length of each of the straight sides of the regular triangle of the cross section of the receiving cavity 10*a* is greater than the diameter of the tube lamp D. The length of each of the straight sides of the regular tetragon of the cross section of the receiving cavity 10*a* is substantially equal to the diameter of the tube lamp D. The length of each of the straight sides of the regular pentagon of the cross section of the receiving cavity 10*a* is less than the diameter of the tube lamp D. The length of each of the straight sides of the regular hexagon of the cross section of the receiving cavity 10*a* is less than the diameter of the tube lamp D. The length of each of the straight sides of the regular hexagon of the cross section of the receiving cavity 10*a* is less than that of each of the straight sides of the regular pentagon of the cross section of the receiving cavity 10*a*.

In the embodiment, as shown in FIG. 1, FIG. 2, and FIG. 3, the two bent sections 12 at two sides of the support section 11 are symmetric with respect to the support section 11. The two receiving cavities 10*a* are symmetric with respect to the central line in the width direction X.

Figure 9:
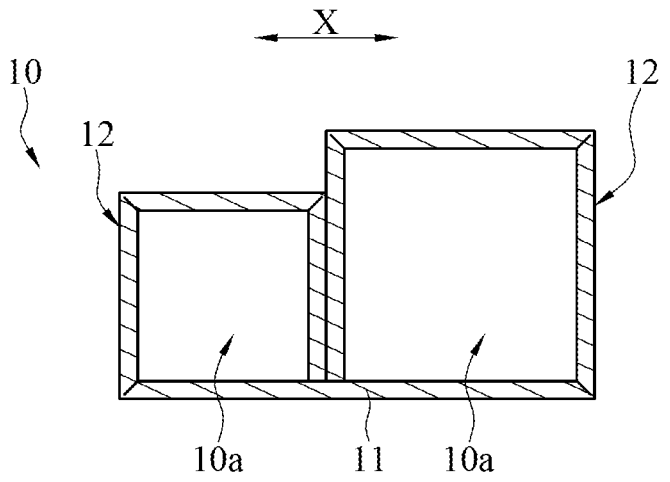
FIG. 9 illustrates a cross section of a middle case of which the shape of a cross section of each of receiving cavities is a regular tetragon and the sizes of the receiving cavities are different according to the first embodiment of the instant disclosure.
Figure 10:
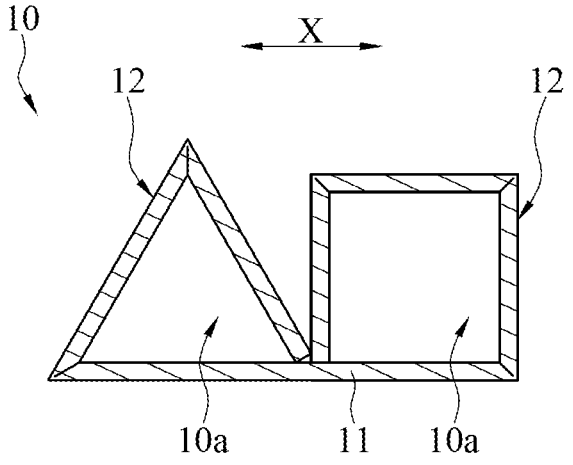
FIG. 10 illustrates a cross section of a middle case of which the shapes of cross sections of receiving cavities are different according to the first embodiment of the instant disclosure.

In some embodiments, the two bent sections 12 at two sides of the support section 11 are asymmetric with respect to the support section 11, and, consequently, the two receiving cavities 10*a* are asymmetric. For example, as shown in FIG. 9, the two bent sections 12 at two sides of the support section 11 are different in size in the width direction X before being bent. After the two bent sections 12 are bent multiple times (the times each of the two bent sections being bent are the same), the two bent sections and the support section 11 respectively form two receiving cavities 10*a* with different sizes so as to receive tube lamps with different sizes. For example, tube lamps with different sizes have different diameters. The diameter of a T12 tube lamp is 38.1 mm, the diameter of a T10 tube lamp is 31.8 mm, the diameter of a T8 tube lamp is 25.4 mm, the diameter of a T5 tube lamp is 16 mm, the diameter of a T4 tube lamp is 12.7 mm, and the diameter of a T2 tube lamp is 6.4 mm. In addition, the two bent sections 12 can be bent multiple times, and the times each of the two bent sections being bent are different; therefore, the two receiving cavities 10*a* have different shapes. For example, as shown in FIG. 10, the shapes of projections of the two receiving cavities 10*a* along the length direction are respectively a regular triangle and a regular tetragon. Alternatively, the shapes of projections of the two receiving cavities 10*a* along the length direction can be any kind of regular polygons while the numbers of straight sides of the two regular polygons are different.

Referring to FIG. 1 and FIG. 3, each of the two bent sections 12 comprises a free end c1. After the two bent sections 12 are bent, at least one of the free ends c1 of the two bent sections 12 are connected to the support section 11 to form the receiving cavity 10*a* for receiving the tube lamp D and to completely wrap the tube lamp D in the circumferential direction. When the free end c1 is connected to the support section 11, the receiving cavity 10*a* is sealed in the circumferential direction, and the tube lamp D is completely wrapped and received in the receiving cavity 10*a* in the circumferential direction.

As shown in FIG. 3, the two free ends c1 of the two bent sections 12 are both connected to the support section 11. After the two bent sections 12 are bent, the shapes of projections of the two receiving cavities 10*a* are regular tetragons. Before the two bent sections 12 are bent (referring to FIG. 3), the width of the middle case 10 is eight times of the diameter of the tube lamp D plus twice of the thickness of the piece of the cardboard such that two tube lamps D can be protected by being completely wrapped by the cardboard (the bent sections 12 and the support section 11). The length of the middle case 10 in the length direction of the tube lamp D is not less than that of the tube lamp D such that the tube lamp D can be completely wrapped and received in the length direction.

As shown in FIG. 3, the packing process of packing the tube lamps D is described below. Two tube lamps D are placed at the center of the support section 11 side by side and are spaced from each other by an interval equal to twice of the thickness of the cardboard in advance. Each of the bent sections 12 is bent three times along the circumferential direction and is bent to a 90 degrees angle each time. During the last time of bending, the two bent surfaces c respectively at the outmost ends of the two bent sections 12 are simultaneously bent into the interval between the two tube lamps D. The two bent surfaces c are overlapped with each other. As shown in FIG. 5(*a*), after the two bent sections 12 are bent, the shapes of projections of the two receiving cavities 10*a* are regular triangles. Before the two bent sections 12 are bent, the width of the middle case 10 is preferably six times of the length of the straight side of the regular triangle of the receiving cavity 10*a*. The two free ends c1 are connected to the support section 11 at the interval between the two tube lamps D (not shown). The bent surfaces c respectively at the outmost ends of the two bent sections 12 are not overlapped with each other. The length of the middle case 10 in the length direction of the tube lamp D is not less than that of the tube lamp D such that the tube lamp D can be completely wrapped in the length direction.

As shown in FIG. 6(*a*), FIG. 7(*a*), and FIG. 8(*a*), the shapes of projections of the two receiving cavities 10*a* of FIG. 6(*a*), FIG. 7(*a*), and FIG. 8(*a*) are respectively regular pentagons, regular hexagons, and regular octagons after the two bent sections 12 are bent. Before the two bent sections 12 are bent, the width of the middle case 10 matches:

$$L>2nl+2h$$

Wherein L is the width of the middle case 10 in the width direction X while the bent sections 12 are not bent, n is the number of straight sides of the regular polygon of the cross section of the receiving cavity 10*a*, l is the length of each of the straight sides of the regular polygon of the cross section of the receiving cavity 10*a*, and h is the thickness of the cardboard. Before the two bent sections 12 are bent, the width L of the middle case 10 is preferably greater than twice of the number n of straight sides times the length l of the straight side plus twice of the thickness h of the cardboard. The two free ends c1 are connected to the support section 11 at the interval between the two tube lamps D (not shown). The bent surfaces c respectively at the outmost ends of the two bent sections 12 shown in FIG. 6, FIG. 7, and FIG. 8 are not overlapped with each other. The length of the middle case 10 in the length direction of the tube lamp D is not less than that of the tube lamp D such that the tube lamp D can be completely wrapped in the length direction.

As shown in FIG. 5(*a*), the two free ends c1 of the two bent sections 12 of which the shapes of the cross sections of the receiving cavities 10*a* are regular triangles are adjacent to each other while the two free ends c1 are connected to the support section 11. As shown in FIG. 6(*a*), FIG. 7(*a*), and FIG. 8(*a*), the two free ends c1 of the two bent sections 12 of which the shapes of the cross sections of the receiving cavities 10*a* are respectively regular pentagons, regular hexagons, and regular octagons are spaced form each other while the two free ends c1 are connected to the support sections 11. It shall be understood that the two free ends c1 of FIG. 5(*a*) can also be spaced from each other.

In some embodiments, after the bent sections 12 are bent, an interval (i.e., a gap) can be formed between the free ends c1 and the support section 11, as shown in FIGS. 1(*b*), 5(*b*), 6(*b*), 7(*b*), and 8(*b*). In other words, the receiving cavity 10*a* comprises an opening G in the circumferential direction. The tube lamp D is not completely wrapped in the receiving cavity 10*a* in the circumferential direction, and a small part of the tube lamp D is exposed to outside because of the opening G In the embodiments shown in FIGS. 1(*b*), 5(*b*), 6(*b*), 7(*b*), and 8(*b*), it shall be understood that the length of the bent surface c of the bent section 12 can be adjusted, and the shape of the cross section of the receiving cavity 10*a*, i.e., the projection of the receiving cavity 10*a* along the length direction, is similar to a regular polygon. The correlation between the length of the bent surface c and the diameter of the tube lamp D is described below. The length of the bent surface c can be greater than, be less than, or be substantially equal to the diameter of the tube lamp D while the shape of the cross section of the receiving cavity 10*a* is similar to regular triangle. The length of the bent surface c can be less than or be substantially equal to the diameter of the tube lamp D while the shape of the cross section of the receiving cavity 10*a* is similar to a regular tetragon. The length of the bent surface c is less than the diameter of the tube lamp D while the shape of the cross section of the receiving cavity 10*a* is similar to a regular pentagon. The length of the bent surface c is less than the diameter of the tube lamp D while the shape of the cross section of the receiving cavity 10*a* is similar to a regular hexagon. The aforementioned rules can be analogously applied to other kinds of regular polygons.

In some embodiment, as shown in FIG. 4(*b*), the cardboard of the middle case 10 can comprise one or more holes 10*b*. In that situation, a circumferential wall (i.e., the side walls forming the receiving cavities 10*a*) of the middle case 10 comprises one or more through holes after the cardboard is bent to form the middle case 10. A part of the circumferential surface of the tube lamp D in the middle case 10 is exposed to outside through the through holes 10*b*. Users can see the part of the circumferential surface of the tube lamp D in the middle case 10 through the through hole. It shall be noticed that the completeness of the middle case 10 must be considered while the holes 10*b* is provided on the middle case 10. The middle case 10 shouldn't be separated into two or more individual parts by the holes 10*b*.

In the embodiment, as shown in FIG. 1 and FIG. 2, the two bent sections 12 at two opposite sides of the support section 11 are bent towards the same side of the support section 11.

Figure 11:
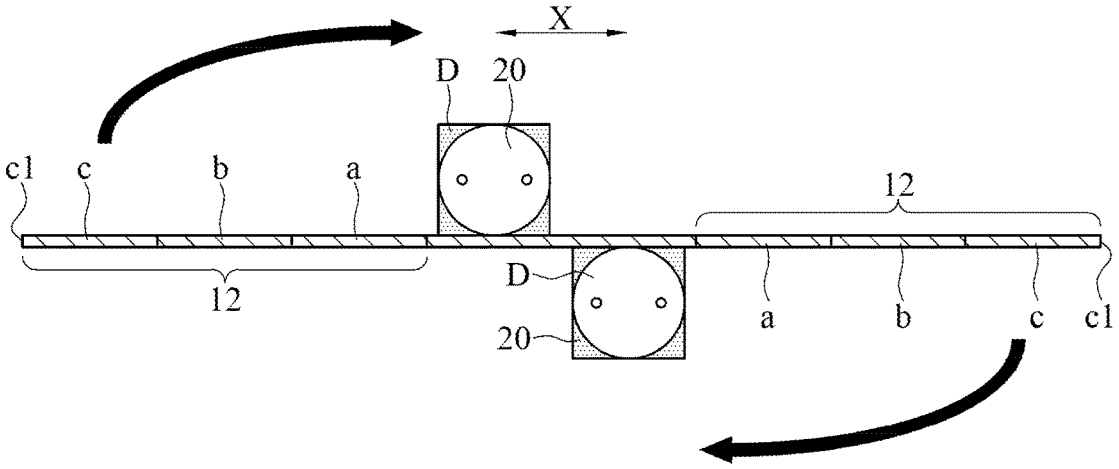
FIG. 11 illustrates a cross section of bent sections being bent towards different sides of a support section according to the first embodiment of the instant disclosure.
Figure 12:
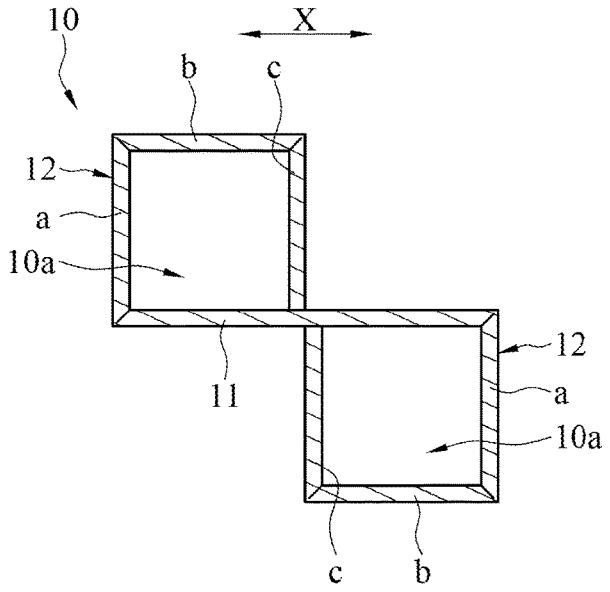
FIG. 12 illustrates a cross section of the middle case of FIG. 11 of which the bent sections have been bent.

In some embodiments, the two bent sections 12 at two opposite sides of the support section 11 are bent towards different sides of the support section 11. As shown in FIG. 11 and FIG. 12, the shape of the cross section of the receiving cavity 10*a* is regular tetragon. One of the two bent sections 12 of the middle case 10 is bent towards upside of the bearing surface 11, and the other one of the two bent sections 12 of the middle case 10 is bent towards downside of the bearing surface 11. One of the two receiving cavities 10*a* is at upside of the bearing surface 11, and the other one of the two receiving cavities 10*a* is at downside of the bearing surface 11. In the embodiment, the support section 11 is not bent.

Figure 13:
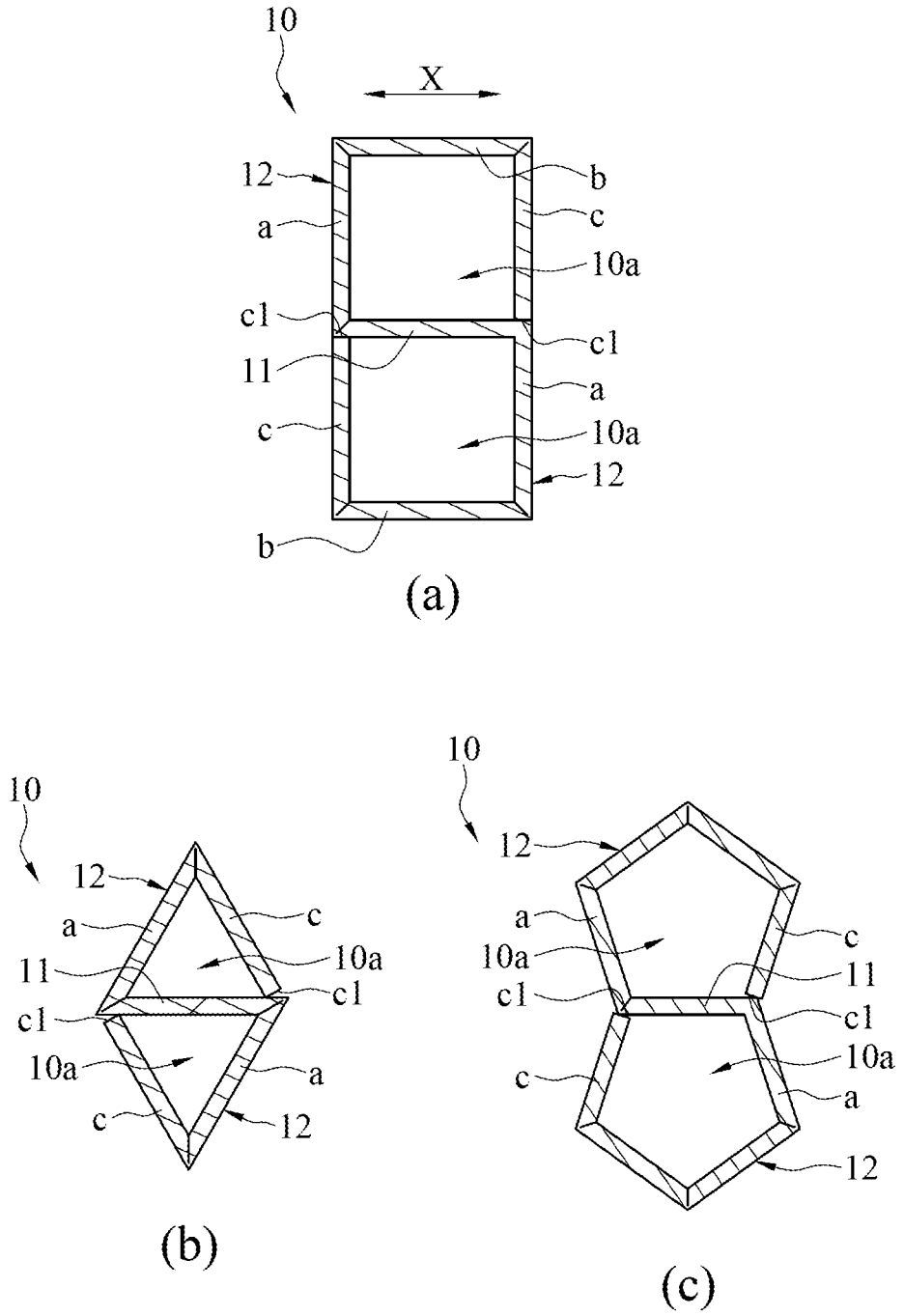
FIG. 13 illustrates cross sections of middle cases of which the bent sections are bent towards different sides of the support sections to form receiving cavities sharing the support sections according to the first embodiment of the instant disclosure.

Under the circumstance that the support section 11 is not bent, and the two bent sections 12 are bent towards different sides of the support section 11, the size of the two receiving cavities 10*a* can be varied by adjusting the size of the bent sections 12 in the width direction X (i.e., the width of the bent sections 12 in the width direction X before being bent). As shown in FIG. 13(*a*), the shape of the cross section of the receiving cavity 10*a* is regular tetragon. One of the free ends c1 is connected to one of the two opposite ends of the support section 11 while the width of the bent section 12 is sufficient to do so, and the other one of the free ends c1 is connected to the other one of the two opposite ends of the support section 11. In that situation, the receiving cavity 10*a* can have a maximum size. In the embodiment, the support section 11 is not bent. In the embodiment that the shape of the cross section of the receiving cavity 10*a* is regular tetragon, the width of the support section 11 is preferably equal to the diameter of the tube lamp D plus twice of the thickness of the cardboard. In some embodiments, the shape of the cross section of the receiving cavity 10*a* (i.e., the projection of the receiving cavity 10*a* along the length direction) is a regular polygon, and the width of the support section 11 can be preferably substantially equal to the length of the straight side of the regular polygon. Accordingly, as shown in FIG. 13(*b*) and FIG. 13(*c*), the shapes of the cross sections of the receiving cavities 10*a* of FIG. 13(*b*) and FIG. 13(*c*) are respectively regular triangles and regular pentagons. The widths of the support sections 11 of FIG. 13(*b*) and FIG. 13(*c*) are respectively equal to the lengths of the straight sides of the regular triangle and the regular pentagon.

Figure 14:
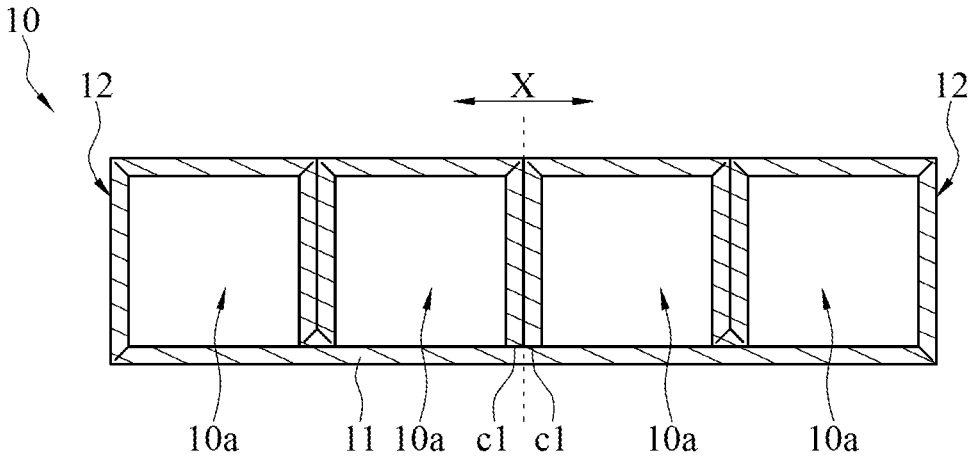
FIG. 14 illustrates a cross section of bent sections each of which forms a plurality receiving cavities according to the first embodiment of the instant disclosure.

In some embodiments, one bent section 12 can be bent to form a plurality of receiving cavities 10*a* aligned in the width direction X. As shown in FIG. 14, the shape of the cross section of the receiving cavity 10*a* is regular tetragon. The dotted line of FIG. 14 represents the center of the support section 11 in the width direction X. Each of the bent sections 12 is bent towards the support section 11 and forms plural receiving cavities 10*a*. Each of the bent sections 12 is bent towards the support section 11 to form two receiving cavities 10*a* in FIG. 14. However, it shall be understood that the receiving cavities 10*a* that each of the bent sections 12 forms can be more than two while the width of the bent section 12 in the width direction X is sufficient. For example, the even number of the receiving cavities 10*a* that each of the bent sections 12 and the support section 11 respectively form is 2, 4, 8, or 16.

Figure 15:
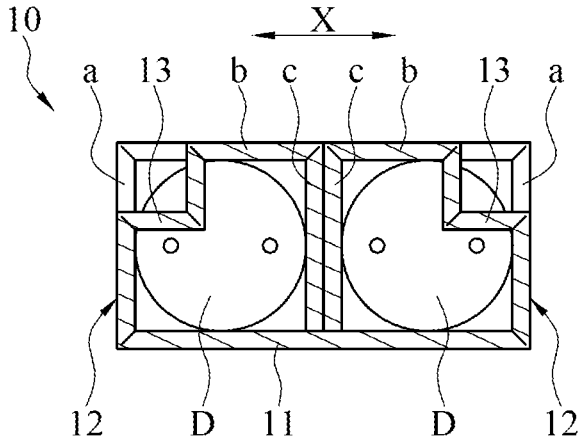
FIG. 15 illustrates a cross section of a protective structure in a middle case according to the first embodiment of the instant disclosure.
Figure 16:
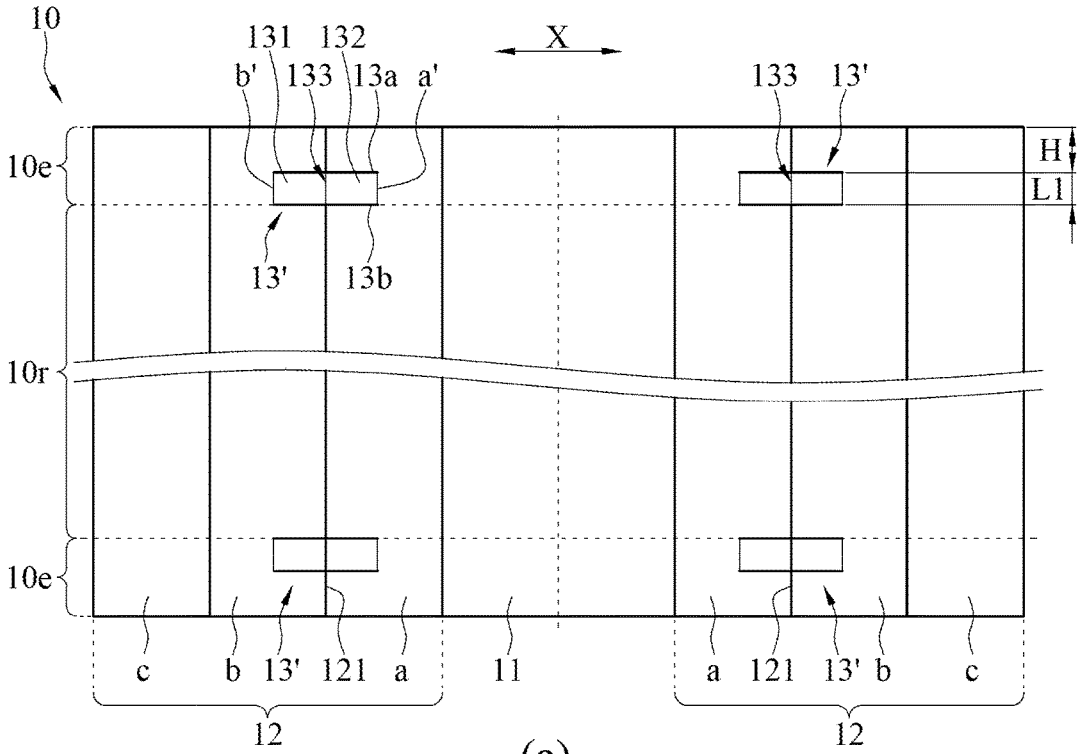
FIG. 16 illustrates diagrams of a middle case before and after being bent according to the first embodiment of the instant disclosure.
Figure 16:
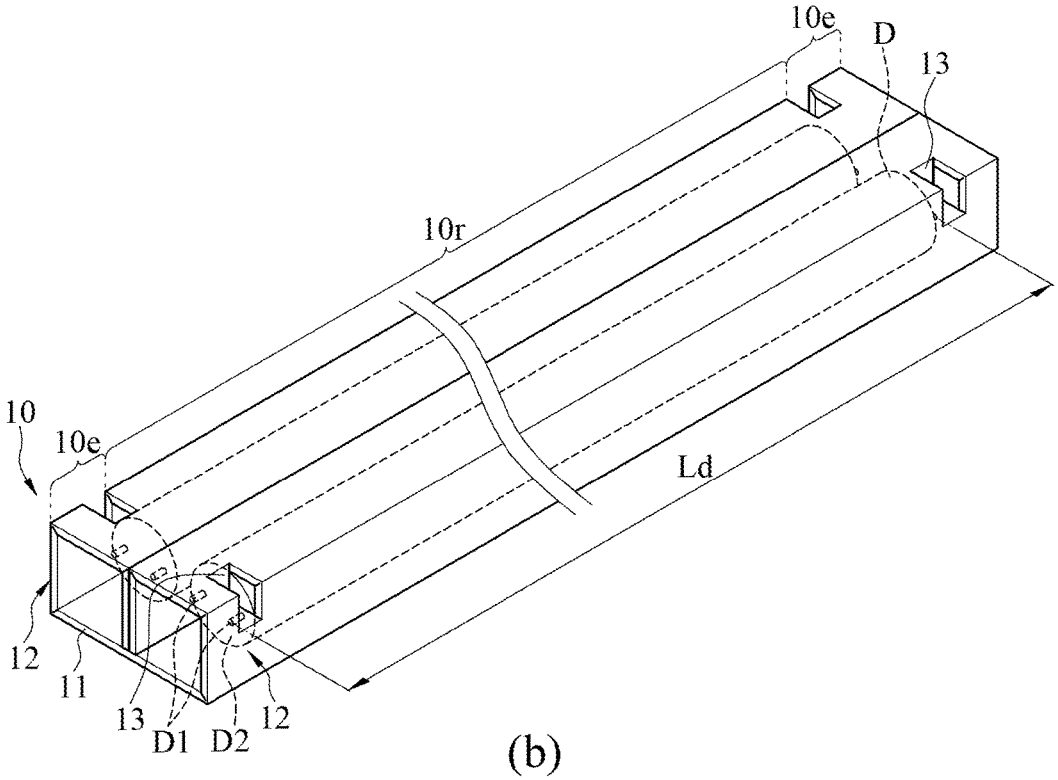

Referring to FIGS. 15 and 16, FIG. 16(*a*) is a top view of a spread middle case 10, and FIG. 16(*b*) is a perspective view of the middle case 10 of FIG. 16(*a*) and tube lamps D received therein. The spread middle case 10 shown in FIG. 16(*a*) is merely half of the whole middle case 10 in the length direction. The middle case 10 comprises at least one protective structure 13 disposed in the receiving cavity 10*a*. The protective structure 13 is for being against one end of the tube lamp D received in the receiving cavity 10*a* and is for preventing the tube lamp D from moving out of the receiving cavity 10*a* along the length direction.

As shown in FIG. 16(*a*) and FIG. 16(*b*), the length of the receiving cavity 10*a* in the length direction is greater than that of the tube lamp D. Each of the receiving cavities 10*a* is defined as a receiving part 10*r* and at least one extending part 10*e* in the length direction. In the embodiment, as shown in FIG. 16(*a*) and FIG. 16(*b*), each of the receiving cavities 10*a* is defined as one receiving part 10*r* and two extending parts 10*e* in the length direction. The receiving part 10*r* is between the two extending parts 10*e* in the length direction. The receiving part 10*r* is for receiving the tube lamp D, and the protective structure 13 is disposed in the extending part 10*e*. In other words, the length of the receiving part 10*r* in the length direction is substantially equal to that of the tube lamp D, and the receiving part 10*r* completely wraps and receives the tube lamp D in the length direction. The position of the protective structure 13 is corresponding to the end of the tube lamp D such that the protective structure 13 restricts the displacement of the tube lamp D in the length direction. As shown in FIG. 16(*b*), the lamp length Ld is the shortest distance between two end surfaces D2 at two opposite ends of the tube lamp D. Conductive pins D1 on the end surfaces D2 are excluded regarding the lamp length Ld.

More particularly, as shown in FIG. 15 and FIG. 16, each of the receiving cavities 10*a* is formed by a plurality of side walls. The side walls are formed by the support section 11 and the bent section 12 or are formed by the bent section 12. The side walls forming each of the receiving cavities 10*a* comprises a first side wall a and a second side wall b adjacent to each other in the circumferential direction. The protective structure 13 is formed on the first side wall a and the second side wall b. The first side wall a and the second side wall b are the same as the bent surface a and the bent surface b adjacent to each other of the bent section 12.

The protective structure 13 comprises two edges and an inversely bent section 13'. The two edges are spaced from each other in the length direction and are respectively defined as a first edge 13*a* and a second edge 13*b*. Both of the first edge 13*a* and the second edge 13*b* cross the first side wall a and the second side wall b in the circumferential direction and are respectively separated from the first side wall a and the second side wall b. For example, the first edge 13*a* and the second edge 13*b* can be cut from the first side wall a and the second side wall b.

As shown in FIG. 16, the portion between the first edge 13*a* and the second edge 13*b* forms the inversely bent section 13' after the first edge 13*a* and the second edge 13*b* are cut from the first side wall a and the second side wall b. The inversely bent section 13' comprises a first border a' and a second border b'. The first border a' and the second border b' are respectively at two opposite ends of the inversely bent section 13' in the width direction X. The first border a' is at the first side wall a, and the second border b' is at the second side wall b. The inversely bent section 13' is bent towards the inner side of the receiving cavity 10*a*. The first border a' and the second border b' are lines or bent edges formed by bending (folding). The protective structure 13 shown in FIG. 15 is formed while the first edge 13*a* and the second edge 13*b* are cut from the first side wall a and the second side wall b, and the inversely bent section 13' is bent towards the inner side of the receiving cavity 10*a*.

Referring to FIG. 15 and FIG. 16, a first bent edge 121 is formed between the first side wall a and the second side wall b. The inversely bent section 13' comprises two bent surfaces which are defined as a first bent surface 131 and a second bent surface 132. A second bent edge 133 is formed between the first bent surface 131 and the second bent surface 132.

In the embodiment, before the inversely bent section 13' is bent, the first bent edge 121 and the second bent edge 133 are substantially aligned in the same straight line. As shown in FIG. 16(*a*), before the bent sections 12 are bent, the first bent edges 121 and the second bent edges 133 overlap with each other. The protective structures 13 shown in FIG. 15 are formed while the bent sections 12 and the inversely bent sections 13' are bent. The projection of the protective structure 13 along the length direction is a regular tetragon (a square). That is to say, the shape of a cross section of the protective structure 13 enclosed by the inversely bent section 13', the first side wall a, and the second side wall b in the radial direction of the tube lamp D is a square.

There can be an interval between the inversely bent section 13' and an end edge of the middle case 10, i.e., an end edge of the extending part 10*e* away from the receiving part 10*r* of the receiving cavity 10*a* on which an opening of the extending part 10*e* forms. Alternatively, there can be no interval between the inversely bent section 13' and the end edge of the middle case 10. As shown in FIG. 16, there is an interval between the inversely bent section 13' and the end edge of the middle case 10. As shown in FIG. 16(*a*), the protective structure 13 is spaced from the end edge of the middle case 10 by the interval, and the interval between the inversely bent section 13' and the end edge of the middle case 10 in the length direction is defined as a distance H. When the end edge of the middle case 10 is collided with something, the part of the middle case 10 between the end edge and the protective structure 13 can absorb a part of the force of impact in advance such that the force of impact won't be directly completely transferred to the protective structure 13, and, consequently, the force of impact transferred to the tube lamp D can be significantly reduced. Thus the tube lamp D is not easily damaged due to impact. A length L1 of the inversely bent section 13' (i.e., the protective structure 13) in the length direction is between 1 cm and 3 cm and is preferably 2 cm. More particularly, as shown in FIG. 16(*a*), the interval between the first edge 13*a* and the second edge 13*b* of the inversely bent section 13' in the length direction is between 1 cm and 3 cm and is preferably 2 cm. If the length L1 of the inversely bent section 13' is too short, the solidness of the protective structure 13 is insufficient to stably hold the tube lamp D. However, the material of the cardboard is waste if the length L1 of the inversely bent section 13' is too long.

As described above, the protective structure 13 is disposed in the extending part 10*e* of the receiving cavity 10*a*. For the aforementioned consideration regarding the length of the protective structure 13 in the length direction, the length of the extending part 10*e* of the receiving cavity 10*a* in the length direction is greater than the length L1 of the inversely bent section 13' in the length direction. For example, the length of the extending part 10*e* of the receiving cavity 10*a* in the length direction is between 10 cm and 20 cm.

In addition, edges of the inversely bent section 13' crossing side walls are perpendicular to the length direction. As shown in FIG. 16, the first edge 13*a* and the second edge 13*b* are substantially perpendicular to the length direction. While the inversely bent section 13' is bent to form the protective structure 13, an end surface of the protective structure 13 in the radial direction (the thickness of the inversely bent section 13') is parallel with the end surface of the tube lamp D such that an area that the end surface of the protective structure 13 contacts the end surface of the tube lamp D is relatively large in comparison with the situation that the end surface of the protective structure 13 is not parallel with the end surface of the tube lamp D, which is beneficial to restrict the displacement of the tube lamp D.

In some embodiments, each of the receiving cavities 10*a* comprises one protective structure 13 close to one of the two opposite ends of the middle case 10. In some embodiments, each of the receiving cavities 10*a* comprises two protective structures 13 respectively close to the two opposite ends of the middle case 10. Under the circumstance that each of the receiving cavities 10*a* comprises two protective structures 13 respectively close to the two opposite ends of the middle case 10, each of the receiving cavities 10*a* is defined as a receiving part 10*r* and two extending parts 10*e* in the length direction. The two extending parts 10*e* are respectively at two opposite ends of the receiving part 10*r*. The receiving part 10*r* is for receiving the tube lamp D, and the two protective structures 13 are disposed in the two extending parts 10*e*. The two protective structures 13 of each of the receiving cavities 10*a* are for being against two opposite ends of the tube lamp D received in the receiving cavity 10*a* and are for preventing the tube lamp D from moving out of the receiving cavity 10*a* along the length direction.

As shown in FIG. 16, the process of forming the protective structure 13 is: preserving the receiving part 10*r* of the middle case 10 in the length direction for receiving the tube lamp D; cutting the first edges 13*a* and the second edges 13*b* of the inversely bent sections 13' on the first side wall a and the second side wall b at two opposite ends of the receiving part 10*r* in the length direction for the tube lamp D; pressing the inversely bent sections 13' to have the inversely bent sections 13' bent towards the inner side of receiving cavity 10*a* to a 90 degrees to form protective structures 13. The protective structures 13 are solid. As shown in FIG. 15, each of the tube lamps D in each of the receiving cavities 10*a* can be protected by the protective structures 13 from being damaged during transportation.

Figure 17:
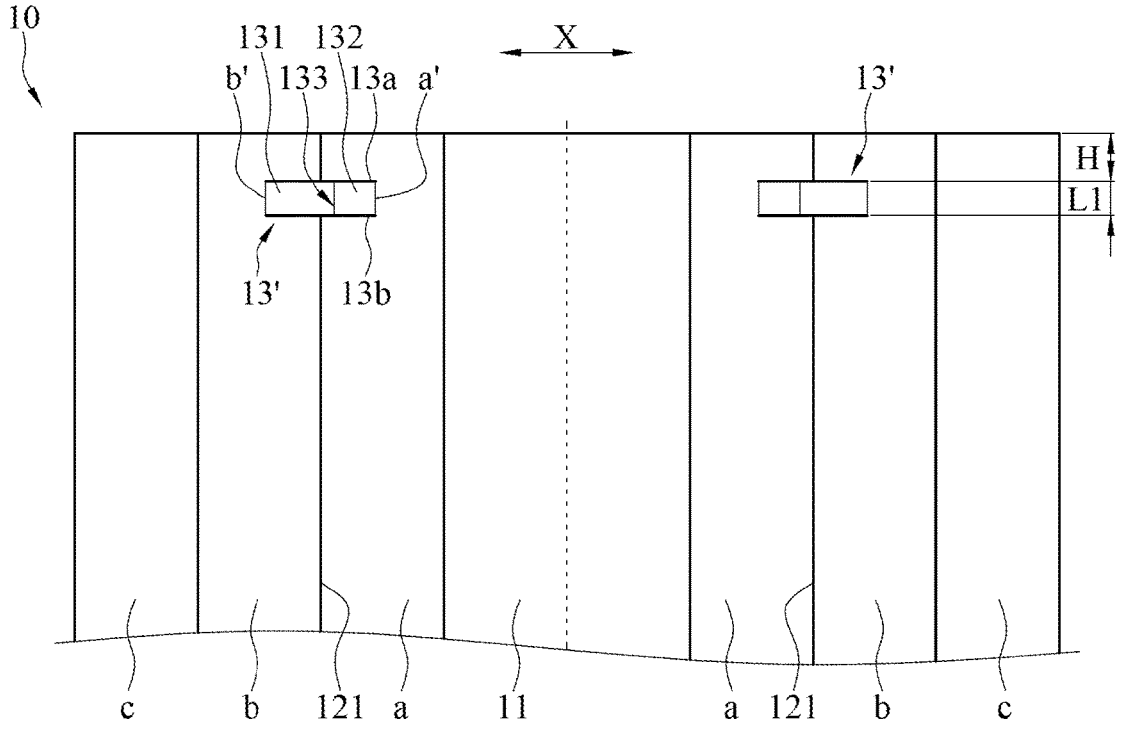
FIG. 17 to FIG. 20 illustrate cross sections of different examples of protective structures according to the first embodiment of the instant disclosure.
Figure 18:
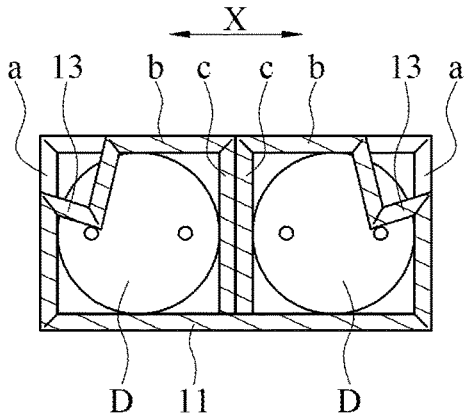

In some embodiment, as shown in FIG. 17 and FIG. 18, before the inversely bent section 13' is bent, the first bent edge 121 and the second bent edge 133 are spaced from each other in the width direction X. That is to say, the first bent edge 121 and the second bent edge 133 are not overlapped with each other. In that situation, the shape of the projection of the protective structure 13 shown in FIG. 18 along the length direction may be a tetragon but not a regular tetragon, which is different from that shown in FIG. 15.

Figure 19:
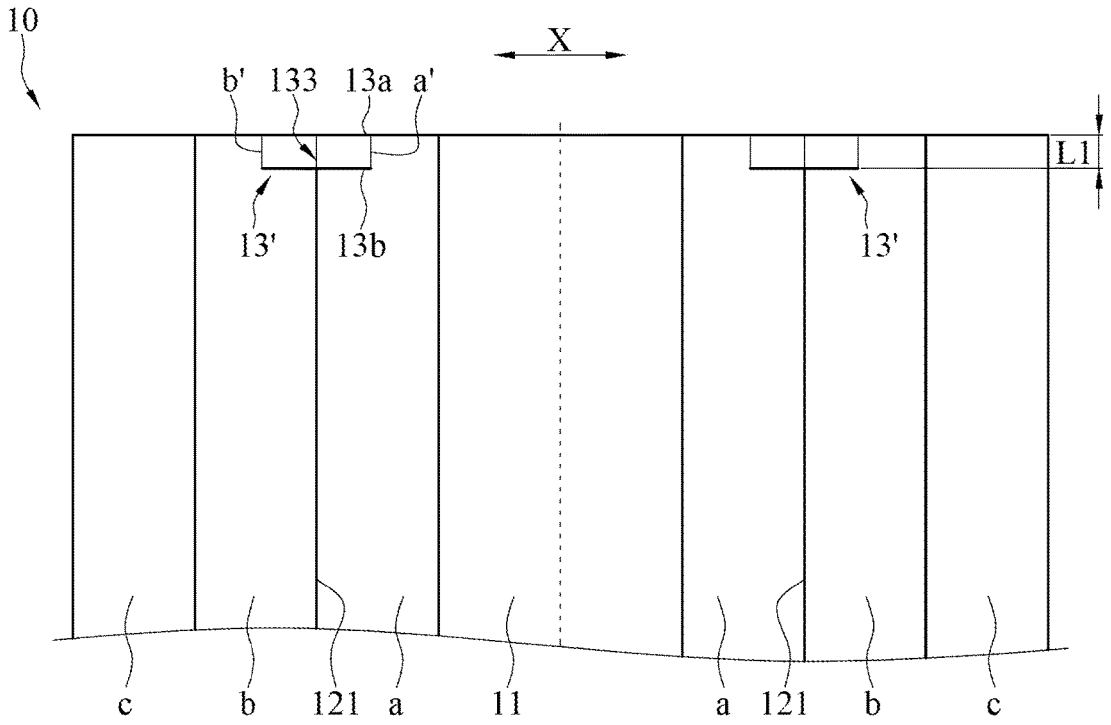

In some embodiments, one of the two edges of the protective structure 13 overlaps the end edge of the middle case 10, i.e., the end edge of the extending part 10*e* away from the receiving part 10*r* of the receiving cavity 10*a*. As shown in FIG. 19, the first edge 13*a* of the inversely bent section 13' overlaps the end edge of the middle case 10 such that an end surface of the protective structure 13 overlaps an end surface of the middle case 10. Thus only one edge of each of the inversely bent sections 13', i.e., the second edge 13*b*, is required to be cut. In that situation, the tube lamp D in the receiving cavity 10*a* of the middle case 10 can be seriously damaged during a falling test due to the collision between an end in the length direction of the middle case 10 and the ground if the length L1 of the protective structure 13 is less than 10 cm. Moreover, the tube lamp D in the receiving cavity 10*a* of the middle case 10 is still damaged during the falling test even if the length L1 of the protective structure 13 is greater than 5 cm. According to a series of falling tests, the tube lamp D won't be damaged on the premise that the length L1 of the protective structure 13 is 10 cm. In other words, the length L1 of the protective structure 13 (the inversely bent sections 13') in the length direction has to be equal to or greater than 10 cm. Under the circumstance, the length of the extending part 10*e* of the receiving cavity 10*a* in the length direction has to be increased, accordingly. The length of the extending part 10*e* of the receiving cavity 10*a* in the length direction must be equal to or greater than that of the inversely bent sections 13'. The length of the extending part 10*e* of the receiving cavity 10*a* in the length direction is equal to that of the inversely bent sections 13' while there aren't any intervals between the inversely bent section 13' and the end edge of the middle case 10. The length of the extending part 10*e* of the receiving cavity 10*a* in the length direction is greater than that of the inversely bent sections 13' while there is an interval between the inversely bent section 13' and the end edge of the middle case 10. In the embodiment that there is an interval between the inversely bent section 13' and the end edge of the middle case 10, the greater the difference between the lengths of the extending part 10*e* and the inversely bent sections 13' is (i.e., the greater the length of the extending part 10*e* in the length direction is), the more the force of impact that the middle case 10 can absorb while being collided with something. On the other hand, the cardboard of the middle case 10 may be waste if there is no collision during transportation.

Figure 20:
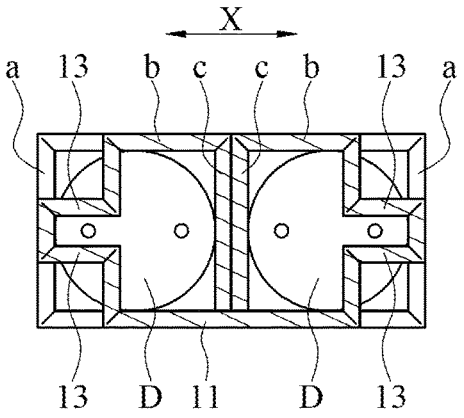

One or more inversely bent sections 13' can be disposed in one extending part 10*e* to form one or more protective structures 13 in one extending part 10*e*, i.e., one or more protective structures 13 can be utilized for being against one end of the tube lamp D. While there are at least two inversely bent sections 13' in one extending part 10*e*, the inversely bent sections 13' are respectively formed on different sets of adjacent side walls. The side walls may pertain to the bent section 12 or the support section 11. As shown in FIG. 20, in addition to one protective structure 13 formed on the side wall (bent surface) a and the side wall (bent surface) b (both the bent surface a and the bent surface b pertain to the bent section 12), another protective structure 13 is formed on the bent surface a and the bearing surface 11. The bent surface a and the bent surface b is a set of adjacent side walls, and the bent surface a and the bearing surface 11 is another set of adjacent side walls. Analogously, the number of the protective structures 13 can be more than two according to the shape of the receiving cavity 10*a*.

Furthermore, referring to FIG. 15, the shape of a cross section of the protective structure 13 enclosed by the inversely bent section 13', the first side wall a, and the second side wall b in the radial direction of the tube lamp D is a tetragon after the inversely bent section 13' is bent inwardly. The length of one of the straight sides of the cross section of the protective structure 13 against the tube lamp D is from ¼ to ¾ of the diameter of the tube lamp D. Preferably, the length of one of the straight sides of the cross section of the protective structure 13 against the tube lamp D is ½ of the diameter of the tube lamp D. Accordingly, the area of the cross section of the protective structure 13 enclosed by the inversely bent section 13', the first side wall a, and the second side wall b in the radial direction is from 1/16 to 9/16 of the area of the cross section of the receiving cavity 10*a* in the radial direction. Preferably, the area of the cross section of the protective structure 13 enclosed by the inversely bent section 13', the first side wall a, and the second side wall b in the radial direction is ¼ of the area of the cross section of the receiving cavity 10*a* in the radial direction. If the size of the protective structure 13 is too small, the protective structure 13 is hard to against the tube lamp D. If the size of the protective structure 13 is too large, the shape of the protective structure 13 may not be solid enough to protect the tube lamp D.

In addition, there can be two protective structures 13 disposed in two extending parts 10*e* at two opposite sides of the receiving part 10*r* to be against two opposite ends of the tube lamp D in the length direction; therefore, the tube lamp D can be tightly clamped by the two protective structures 13 in the length direction. The distance between the two protective structures 13 is determined by the length of the tube lamp D such that the two protective structures 13 are just against the two opposite ends of the tube lamp D. Thus the tube lamp D can be firmly fastened in the inner side of the middle case 10.

Figure 21:
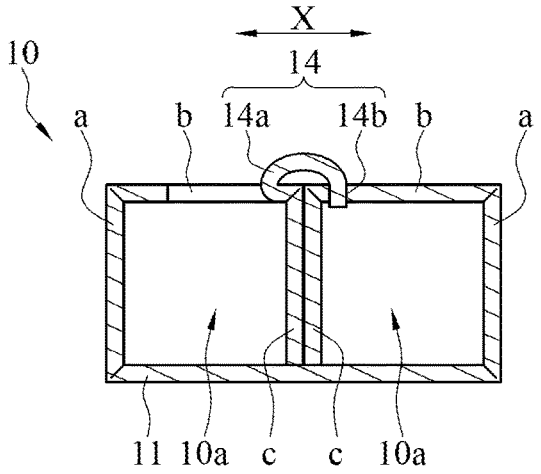
FIG. 21 illustrates a cross section of a connecting structure in a middle case according to the first embodiment of the instant disclosure.

Additionally, referring to FIG. 4 and FIG. 21, the middle case 10 further comprises at least one connecting structure 14. The connecting structure 14 is for fixing the two receiving cavities 10*a* to prevent the bent sections 12 from spreading.

More particularly, the connecting structure 14 comprises at least one male part 14*a* and at least one female part 14*b*. The male part 14*a* and the female part 14*b* are respectively on the side walls forming receiving cavities 10*a*. In the embodiment, the male part 14*a* is on an outer surface of the side wall of one of the two receiving cavities 10*a*, and the female part 14*b* is on an outer surface of the side wall of the other one of the two receiving cavities 10*a*. The male part 14*a* is connected to the female part 14*b* to have at least one receiving cavity 10*a* fixed. In different embodiments, one connecting structure 14 is for fixing one receiving cavity 10*a*, or one connecting structure 14 is for fixing two receiving cavities 10*a* to prevent the bent sections 12 from spreading. The connecting structure 14 can be a coupling structure or an adhesive structure.

As shown in FIG. 4 and FIG. 21, the male part 14*a* and the female part 14*b* of the connecting structure 14 are respectively disposed on the outer surfaces of the side walls forming the two receiving cavities 10*a*. The male part 14*a* is connected to the female part 14*b* to have the two receiving cavities 10*a* fixed. In the embodiment, the number of the connecting structures 14 is equal to or greater than two.

More particularly, the shape of the cross section of the receiving cavity 10*a* is regular tetragon. The bent section 12 is bent to form three bent surfaces a, b, and c. The bent surface a is connected to the support section 11. The bent surface b is connected between the bent surfaces a and c. The bent surface c is the outmost bent surface of each of the bent sections 12. Each of the male parts 14*a* and each of the female parts 14*b* are respectively disposed on the two bent sections 12. The male parts 14*a* are disposed between the bent surfaces b and c of one of the two bent sections 12, and the female parts 14*b* are disposed between the bent surfaces b and c of the other one of the two bent sections 12. A part of the perimeter of the male part 14*a* is cut from the bent surface c, and the other part of the perimeter of the male part 14*a* remains being connected to the bent surface b. The male part 14*a* can be bent outwardly about the part connected to the bent surface b. The female part 14*b* is a through trough formed by cutting a predetermined position between the bent surfaces b and c. The male part 14*a* being bent outwardly can be further inserted into the female part 14*b* such that the male part 14*a* and the female part 14*b* can be connected to each other to have the two receiving cavities 10*a* fixed.

Referring to FIG. 21, FIG. 21 illustrates a relative position of the connecting structure 14 but not a detailed structure of the connecting structure 14. While the male part 14*a* and the female part 14*b* are connected to each other, positions of the two bent surfaces c are fixed, and, consequently, the two receiving cavities 10*a* are fixed. Under the circumstance that the shape of the cross section of the receiving cavity 10*a* is a tetragon, the male part 14*a* and the female part 14*b* are respectively disposed on bent edges of the two bent sections 12 about which the last (the outmost) bent surfaces (the bent surfaces c) are bent.

Referring to FIG. 6 and FIG. 7, under the circumstance that the shape of the cross section of the receiving cavity 10*a* is a pentagon or a hexagon, the male part 14*a* and the female part 14*b* can be respectively disposed on bent edges of the two bent sections 12 about which the last (the outmost) bent surfaces (the bent surfaces c) are bent. Referring to FIG. 8, under the circumstance that the shape of the cross section of the receiving cavity 10*a* is an octagon, the male part 14*a* and the female part 14*b* can be respectively disposed on bent edges of the two bent sections 12 about which the second bent surfaces from the last (the bent surfaces g) are bent. Referring to FIG. 9, one of the male part 14*a* and the female part 14*b* can be disposed on an bent edge of one of the two bent sections 12 forming the smaller receiving cavity 10*a* about which the last bent surface is bent, and the other one of the male part 14*a* and the female part 14*b* can be disposed on the last bent surface of the other one of the two bent sections 12 forming the larger receiving cavity 10*a*. Referring to FIG. 10, the male part 14*a* and the female part 14*b* can be respectively disposed on the last bent surfaces of the two bent sections 12. The last bent surfaces of the two bent sections 12 can contact with each other by bending the support section 11 and can be connected to each other by connecting the male part 14*a* and the female part 14*b*.

In addition, the male part 14*a* and the female part 14*b* can be disposed on the bent surfaces of the two bent sections 12 besides the last bent surfaces on the premise that the free end c1 of the bent section 12 is between the connecting structure 14 and the support section 11 and is fixed to prevent the bent section 12 from spreading while the male part 14*a* is connected to the female part 14*b*.

In some embodiments, the connecting structure 14 can be disposed on the free end c1 of the bent section 12 and the support section 11. The free end c1 can be connected to the support section 11 by the connecting structure 14 to fix the receiving cavity 10*a*. Alternatively, the connecting structure 14 can only be disposed on the free end c1 of the bent section 12.

Figure 22:
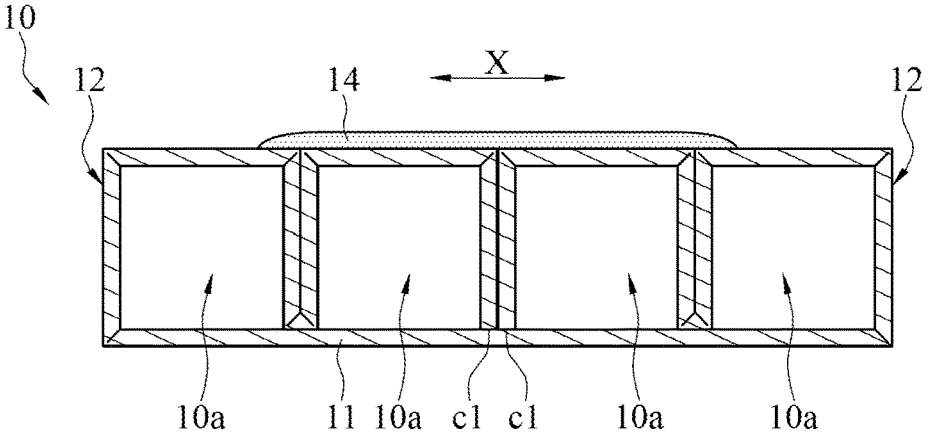
FIG. 22 to FIG. 24 illustrate cross sections of examples of connecting structures in a middle case according to the first embodiment of the instant disclosure.
Figure 23:
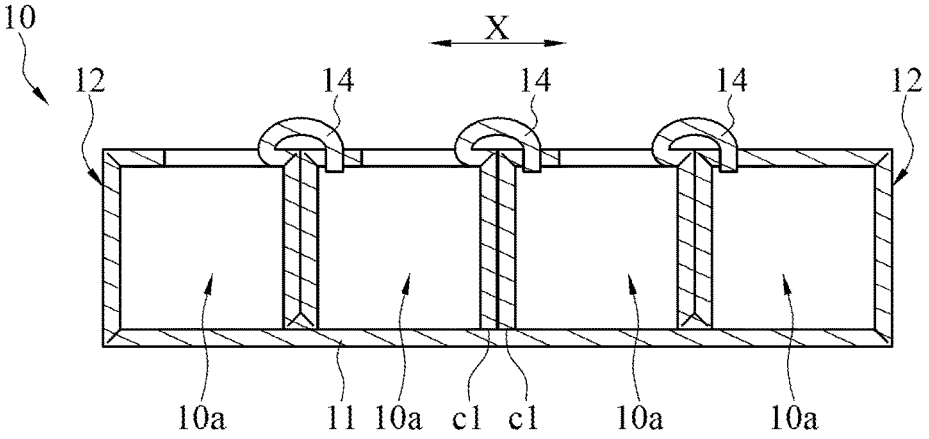

In some embodiments, referring to FIG. 22, one bent section 12 forms a plurality of receiving cavities 10*a*, and the receiving cavities 10*a* are at the same side of the support section 11. In that situation, the connecting structure 14 can be different from the aforementioned structure. The male part 14*a* and the female part 14*b* can be respectively disposed on the outer surfaces of the side walls of the two bent sections 12 respectively forming two receiving cavities 10*a* being outermost in the width direction X and are opposite to the support section 11. Under the circumstance, the length of the male part 14*a* has to be long enough so that an end of the male part 14*a* can cross two receiving cavities 10*a* to be inserted into the female part 14*b*. In the embodiment, as shown in FIG. 22, the connecting structure 14 can be an adhesive structure applied over the outer surfaces of the two bent sections 12 opposite to the bearing surface 11 such that all of the four receiving cavities 10*a* can be fixed. As shown in FIG. 23, the connecting structures 14 are respectively disposed between every two adjacent receiving cavities 10*a*.

Figure 24:
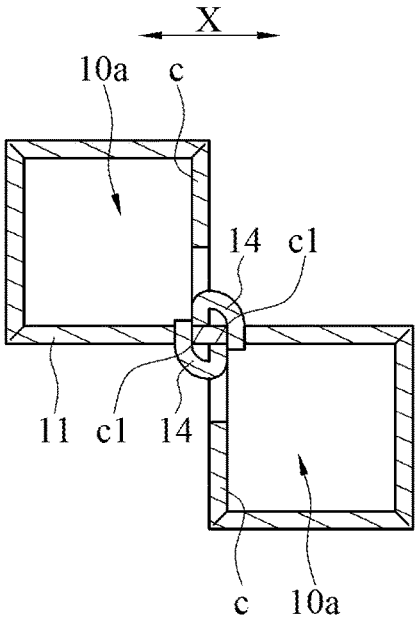

In some embodiments, if the receiving cavities 10*a* are respectively at different sides of the bearing surface 11, i.e., one of the two bent sections 12 is bent towards one side of the bearing surface 11, and the other one of the two bent sections 12 is bent towards the other side of the bearing surface 11, the number of the connecting structures 14 is two or more. As shown in FIG. 24, the two bent sections 12 are respectively bent towards two opposite sides of the support section 11 to form two receiving cavities 10*a*, and the number of the connecting structures 14 is two. The two male parts 14*a* are respectively disposed on (or close to) the two free ends c1 of the bent sections 12, and the two female parts 14*b* are disposed on the support section 11. The two free ends c1 of the bent sections 12 can be respectively connected to the two opposite sides of the support section 11 by the two connecting structures 14.

While there are multiple receiving cavities 10*a* respectively at two opposite sides of the support section 11, the configuration of the connecting structure 14 can be referred to FIG. 23 and FIG. 24.

In some embodiments that the packing box further comprises the inner case 20, as shown in FIG. 3, the inner case 20 wraps the tube lamp D tightly and is around the circumferential surface of the tube lamp D. The middle case 10 is around the inner case 20. During packing, the tube lamp D is wrapped by the inner case 20 in advance, and then is wrapped by the middle case 10.

The material of the inner case 20 can be a corrugated paper. The surface of the inner case 20 facing towards the tube lamp D (i.e., an inner surface of the inner case 20) has a structure of creases. The structure of creases is capable of absorbing the force of impact or vibration to ease the influence of impact or vibration to the tube lamp D. The length of the inner case 20 in the length direction is substantially equal to that of the tube lamp D. The inner case 20 is required to completely wrap the tube lamp D in the circumferential direction. In other words, the size of the inner case 20 in the circumferential direction is equal to or greater than the perimeter of the tube lamp D. Generally, the size of the inner case 20 in the circumferential direction is slightly greater than the perimeter of the tube lamp D.

After the inner case 20 wraps the tube lamp D, the shape of the cross section of the inner case 20 is a circle to tightly fit the circumferential surface of the tube lamp D and to perfectly protect the tube lamp D. Considering the inner case 20 having a circular shape may easily roll to collide with something, the shape of the cross section of the inner case 20 in the embodiment is a square. On the cross section of the inner case 20 and the tube lamp D, each of the straight sides of the square of the shape of the cross section of the inner case 20 contacts the tube lamp D. In the situation, the tube lamp D wrapped by the inner case 20 is easily placed and is hard to roll to collide with something.

Although the inner case 20 with a square cross section is suitable for packing and placing, the shapes of the cross sections of the inner cases 20 in different embodiments are not limited to the square but can be different regular polygons.

The inner case 20 can comprises two end covers (not shown) respectively covering two opposite ends of the inner case 20 in the length direction. The two end covers block the two opposite ends of the tube lamp D in the axial direction (the length direction) to prevent the tube lamp D from moving out of the inner case 20 along the axial direction.

The packing box further comprises an outer case (not shown). The outer case can receive at least two middle cases 10.

After the tube lamp D is packed by the inner case 20 and the middle case 10, the tube lamp D can be protected by the inner case 20 and the middle case 10 in a safe and reliable way. At least two middle cases 10 with the tube lamps D received therein can be piled up in the outer case. In the situation, as least four tube lamps D can be packed in the outer case.

The material of the outer case can be, but not limited to, a single-layer corrugated paper. The outer case can be a one-piece structure and can be a cut cardboard. The cut cardboard only needs to be bent and assembled to form the outer case.

The outer case is bent to form a case body with an opening and a case cover to cover the opening. There can be one or more coupling devices corresponding to each other and capable of being connected to each other respectively disposed on a free end of the case cover and a portion of the case body for being connected to the case cover. The coupling structures are beneficial to the fixation between the case body and the case cover. The packing box can pack at least four tube lamps D. The size of the packing box is appropriate and is easy to carry. The packing boxes are suit for small amount of express delivery, which is safe and convenient. The middle case 10, the inner case 20, and the outer case are made by paper pulp, which is beneficial to recycling and environment protection.

The Second Embodiment

The instant disclosure provides a second embodiment. The difference between the first embodiment and the second embodiment is that the support section 11 of the first embodiment is not bent during the process of forming the receiving cavities 10*a*, but the support section 11 of the second embodiment is bent during the process of forming the receiving cavities 10*a*.

Figure 25:
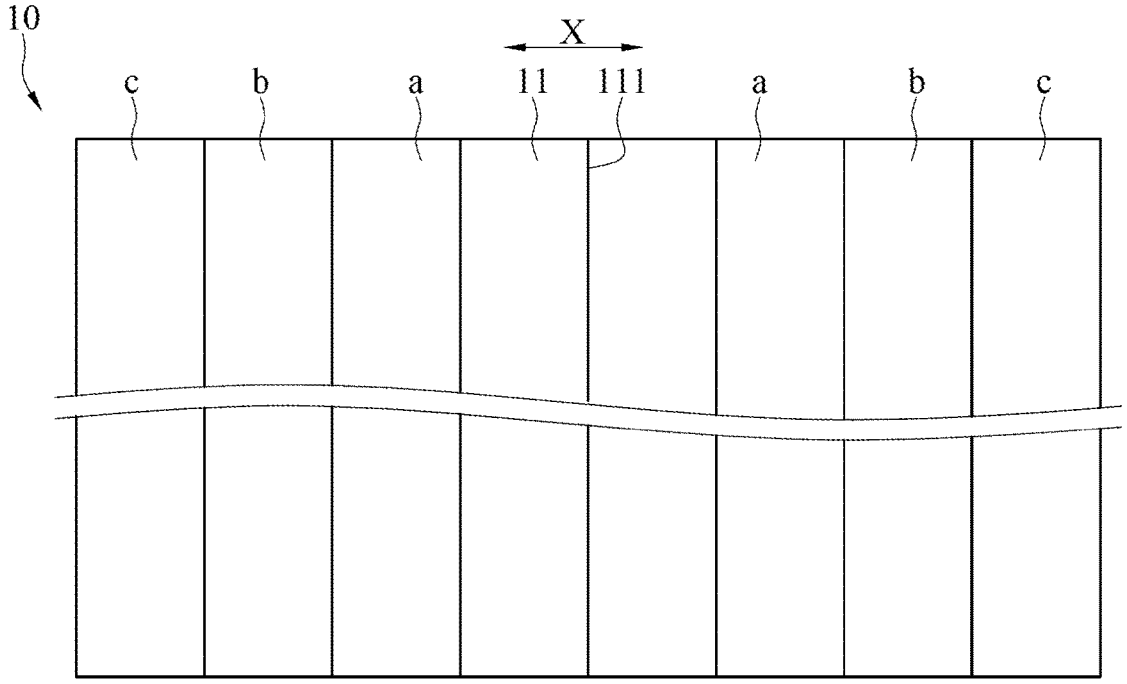
FIG. 25 illustrates a cross section of a middle case before being bent of which the support section has a bent edge according to the second embodiment of the instant disclosure.

Referring to FIG. 25, the support section 11 comprises a bent edge 111 along the length direction of the tube lamp D. The support section 11 can be bent about the bent edge 111.

The support section 11 is bent about the bent edge 111 to (1) alter the alignment of the receiving cavities 10*a* or (2) form the receiving cavities 10*a*.

(1) Regarding that the support section 11 is bent about the bent edge 111 to alter the alignment of the receiving cavities 10*a*, details are as follows.

Before the support section 11 is bent, the receiving cavities 10*a* have been formed already. The bending of the support section 11 is utilized for alter the alignment of the receiving cavities 10*a* but not the shape of the receiving cavities 10*a* or the number of the side walls.

Figure 26:
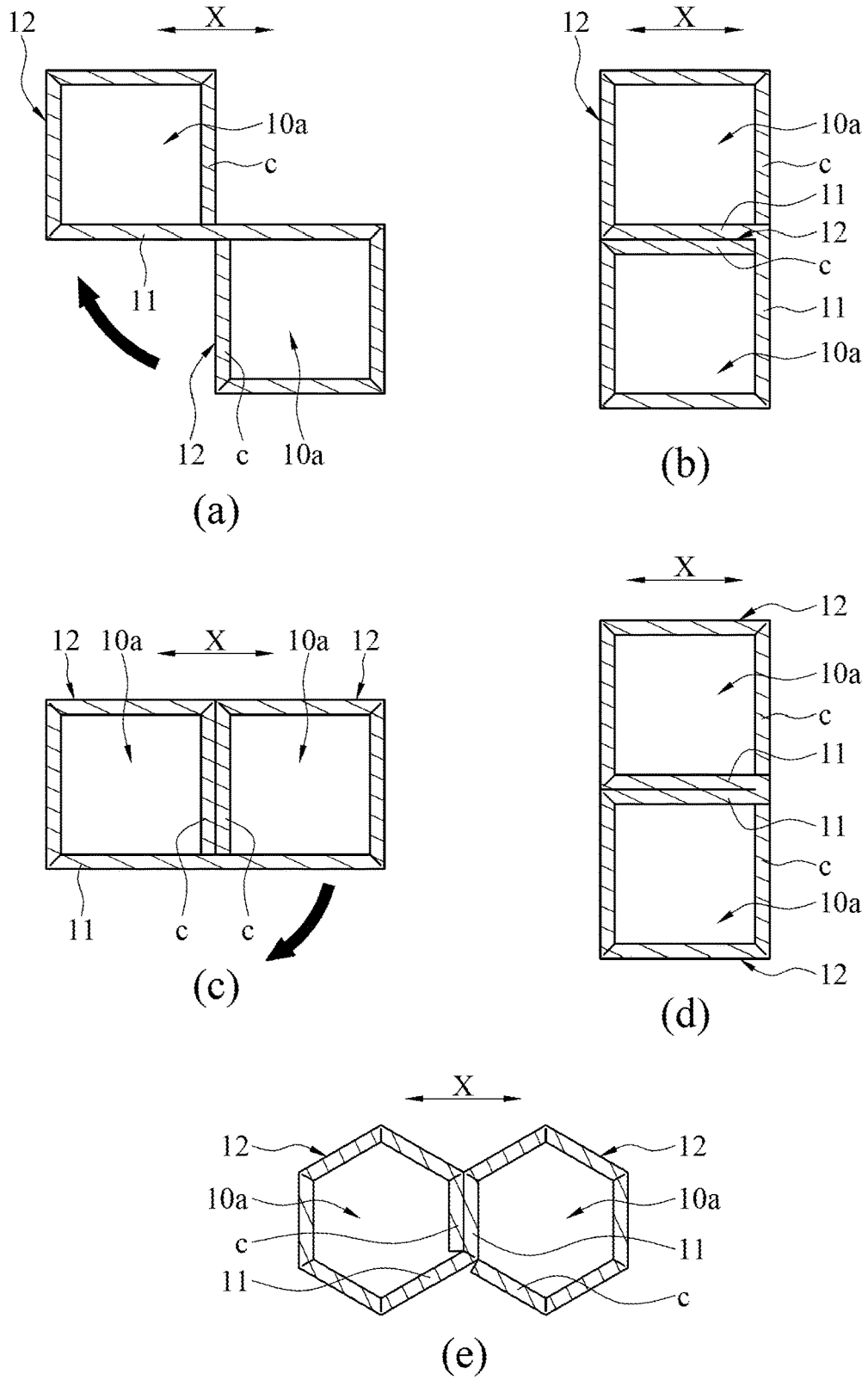
FIG. 26 and FIG. 27 illustrate cross sections of alignments of receiving cavities altered by bending support sections according to the second embodiment of the instant disclosure.

In the embodiment, as shown in FIG. 26, the shape of the cross section of the receiving cavity 10*a* is a regular tetragon. The support section 11 is bent to alter the alignment of the receiving cavities 10*a*. As shown in FIG. 26(*a*), the bent sections 12 are respectively bent towards different sides of the support section 11 before the support section 11 is bent. One of the two bent sections 12 is bent towards upside of the bearing surface 11, and the receiving cavity 10*a* enclosed by the bent section 12 and the support section 11 is at upside of the support section 11. The other one of the two bent sections 12 is bent towards downside of the bearing surface 11, and the receiving cavity 10*a* enclosed by the bent section 12 and the support section 11 is at downside of the support section 11. As shown in FIG. 26 (*a*), the two receiving cavities 10*a* are substantially aligned diagonally. As shown in FIG. 26 (*b*), the two receiving cavities 10*a* are substantially aligned side by side after the support section 11 is bent. The third side wall c of one of the two receiving cavities 10*a* is attached to one of the side walls (a part of the support section 11) of the other one of the two receiving cavities 10*a*. In some embodiments, as shown in FIG. 26 (*c*) and FIG. 26 (*d*), the two bent sections 12 at two sides of the support section 11 are bent towards the same side of the support section 11, and the shape of the cross section of the receiving cavity 10*a* is a regular tetragon. As shown in FIG. 26 (*c*), before the support section 11 is bent, one of the two bent sections 12 is bent towards upside of the bearing surface 11, and the receiving cavity 10*a* enclosed by the bent section 12 and the support section 11 is at upside of the support section 11. The other one of the two bent sections 12 is also bent towards upside of the bearing surface 11, and the receiving cavity 10*a* enclosed by the bent section 12 and the support section 11 is at upside of the support section 11. The two receiving cavities 10*a* are substantially aligned side by side at upside of the support section 11. As shown in FIG. 26(*d*), after the support section 11 is bent about the bent edge, the bent support section 11 is divided into two parts. The two parts of the support section 11 are respectively corresponding to the two receiving cavities 10*a*. The two parts of the support section 11 respectively pertain to side walls forming the two receiving cavities 10*a* and are attached to each other. As shown in FIG. 26(*e*), regarding that the shape of the cross section of the receiving cavity 10*a* is a regular polygon different from the regular tetragon, e.g., a regular hexagon, the alignment of the receiving cavities 10*a* can be altered by bending the support section 11 analogously.

Figure 27:
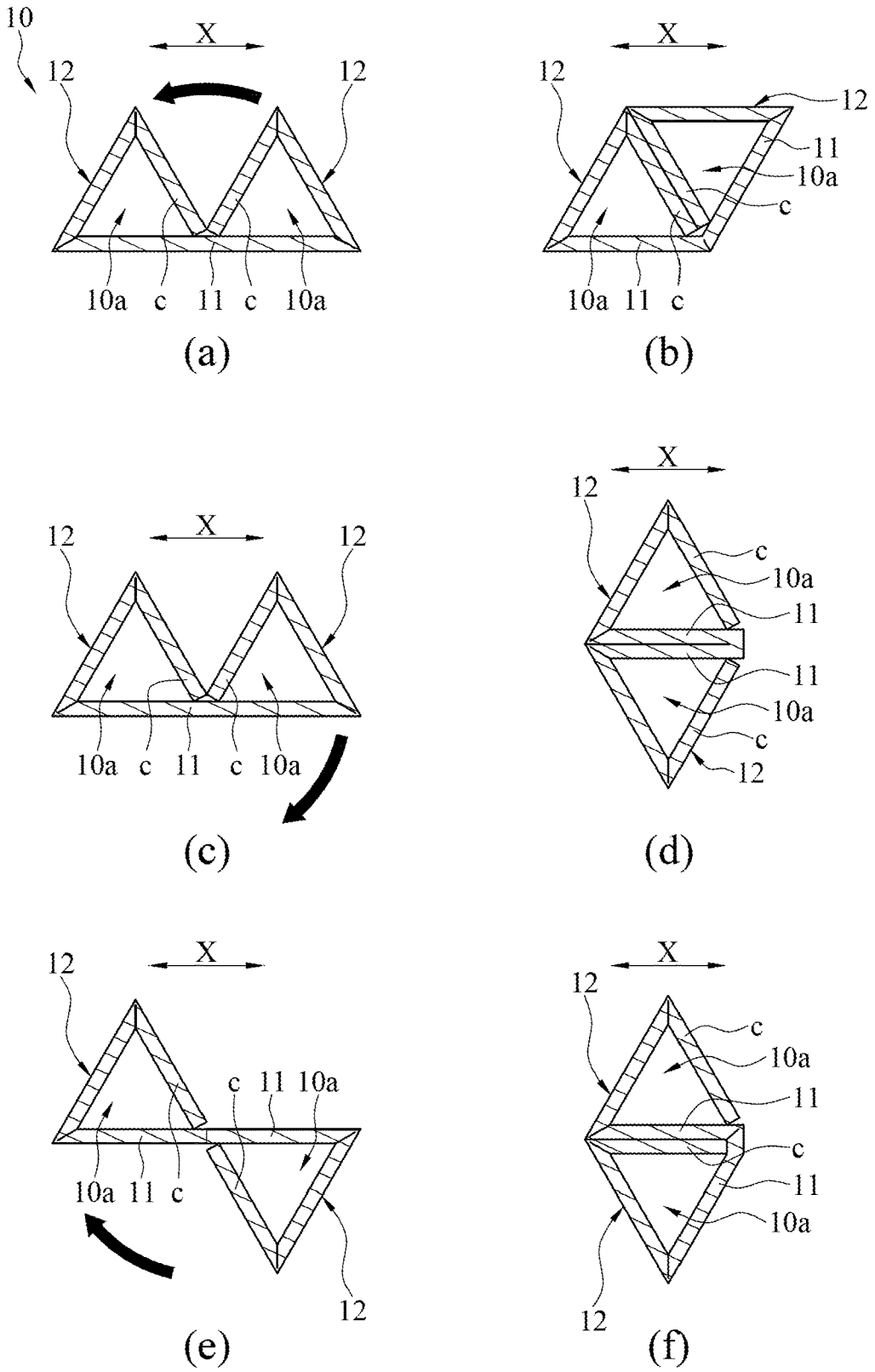

In some embodiments, as shown in FIG. 27, the shape of the cross section of the receiving cavity 10*a* is a regular triangle. The alignment of the receiving cavities 10*a* shown in FIG. 27 can be altered by bending the support section 11. As shown in FIGS. 27(*a*) to 27(*d*), the two receiving cavities 10*a* shown in FIG. 27(*a*) and FIG. 27(*c*) are substantially aligned side by side before the support section 11 is bent. After the support section 11 is bent upwardly, the two receiving cavities 10*a* shown in FIG. 27(*b*) are closed to each other such that the two side walls c of the two receiving cavities 10*a* are attached to each other. Alternatively, after the support section 11 is bent downwardly, the two receiving cavities 10*a* shown in FIG. 27(*d*) are closed to each other such that the two parts of the support section 11 corresponding to the two receiving cavities 10*a* are attached to each other. As shown in FIG. 27(*e*) and FIG. 27(*f*), the two receiving cavities 10*a* of FIG. 27(*e*) are at two opposite sides of the support section 11 and are substantially aligned diagonally before the support section 11 is bent. The support section 11 is bent to have one of the two receiving cavities 10*a* close to the other one of the two receiving cavities 10*a*, as shown in FIG. 27(*f*).

The manner that the alignment of the receiving cavities 10*a* can be altered by bending the support section 11 is suitable for any bent sections 12 of which the shapes of the cross sections of the receiving cavities 10*a* are regular polygons besides the regular tetragon. While one bent section 12 is bent to form a plurality of receiving cavities 10*a* in the width direction as described before, the alignment of the receiving cavities 10*a* can also be altered by bending the support section 11.

According to the aforementioned embodiments, the support section 11 is suitable to be bent to form two side walls attached to each other between the two receiving cavities 10*a* so as to alter the alignment of the receiving cavities 10*a*.

(2) Regarding that the support section 11 is bent about the bent edge 111 to form the receiving cavities 10*a*, details are as follows.

Under the circumstance, the size of one of the bent sections 12 in the width direction is less than that of the other one of the bent sections 12. Thus at least one receiving cavity 10*a* is incomplete while the two bent sections 12 are bent already but the support section 11 is not bent yet. For example, an incomplete receiving cavity 10*a* lacks at least one side wall such that the incomplete receiving cavity 10*a* cannot completely wrap the tube lamp D. In the situation, the support section 11 can be bent to form a side wall that the incomplete receiving cavity 10*a* lacks.

Different situations are illustrated as follows.

The first situation is that the support section 11 can be bent about the bent edge to form one side wall shared by two adjacent receiving cavities 10*a* each of which is formed by a plurality of side walls.

Figure 28:
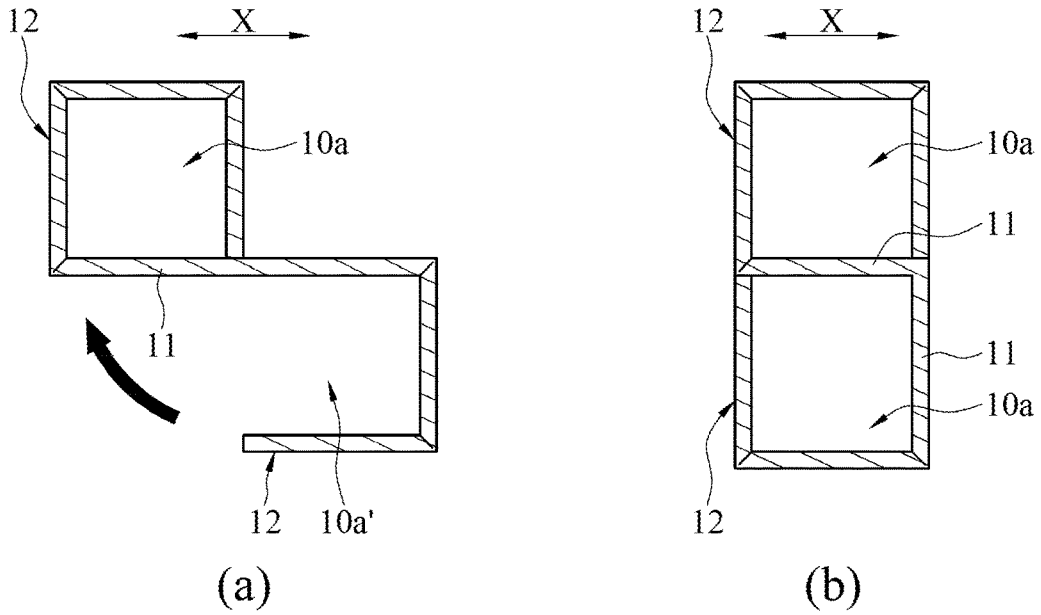
FIG. 28 to FIG. 31 illustrate cross sections of examples of alignments of receiving cavities altered by bending support sections to form side walls of the receiving cavities according to the second embodiment of the instant disclosure.

In the embodiment, as shown in FIG. 28, the shape of the cross section of the receiving cavity 10*a* is a regular tetragon. Before the support section 11 is bent, one of the receiving cavities 10*a*, i.e., the incomplete receiving cavity 10*a*' shown in FIG. 28(*a*), lacks one side wall and, consequently, has an opening. The receiving cavity 10*a*' cannot wrap the tube lamp D completely. After the support section 11 is bent, the opening can be sealed by one side wall of the other receiving cavity 10*a* which is a part of the support section 11, and, consequently, the incomplete receiving cavity 10*a*' become the receiving cavities 10*a* and can wrap the tube lamp D completely. In other words, after the support section 11 is bent, one of the side walls is shared by the two adjacent receiving cavities 10*a*, as shown in FIG. 28(*b*), and the side wall shared by the two adjacent receiving cavities 10*a* is a part of the support section 11.

Figure 29:
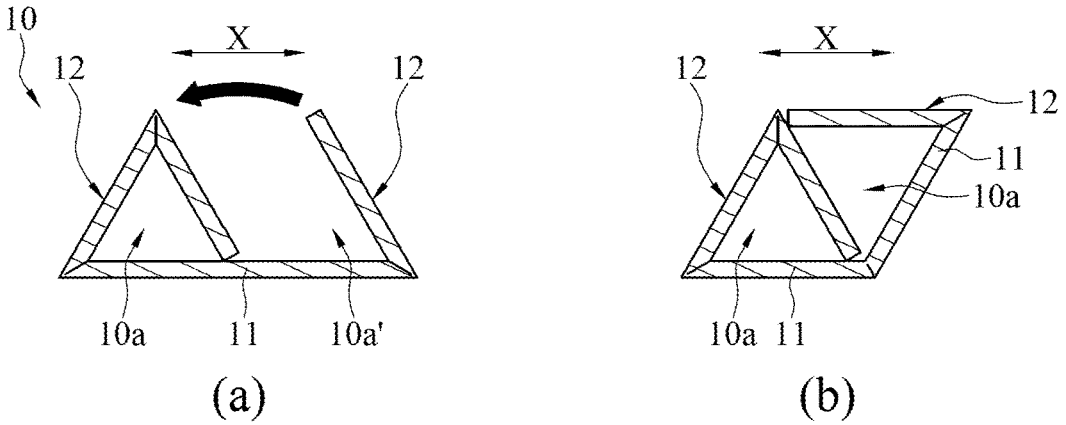

In the embodiment, as shown in FIG. 29, the shape of the cross section of the receiving cavity 10*a* is a regular triangle. Before the support section 11 is bent, one of the receiving cavities 10*a*, i.e., the incomplete receiving cavity 10*a*' shown in FIG. 29(*a*), lacks one side wall and, consequently, has an opening. After the support section 11 is bent, the opening can be sealed by one side wall of the other receiving cavity 10*a* which is a part of the bent section 12. In other words, after the support section 11 is bent, one of the side walls is shared by the two adjacent receiving cavities 10*a*, as shown in FIG. 29(*b*), and the side wall shared by the two adjacent receiving cavities 10*a* is a part of the bent section 12. In another embodiment, one of the two receiving cavities 10*a* lacks one side wall and, consequently, has an opening. The opening is sealed by one side wall (a part of the support section 11) of the other one of the receiving cavities 10*a*.

It shall be understood that the aforementioned manner is suitable for another middle cases 10 of which the shapes of the cross sections of the receiving cavities 10*a* are regular polygons besides the regular tetragon or the regular triangle.

The second situation is that the support section is bent about the bent edge to form two side walls respectively pertaining to two adjacent receiving cavities 10*a* each of which is formed by a plurality of side walls.

Figure 30:
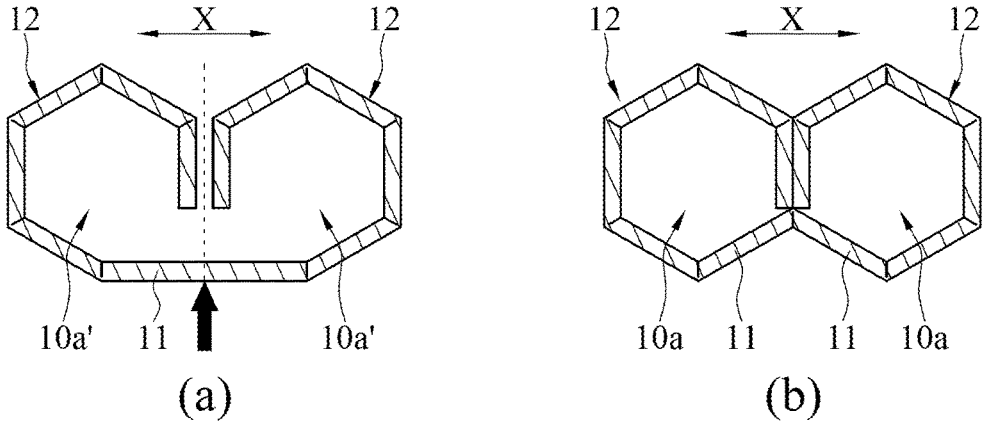

In the embodiment, as shown in FIG. 30, the shape of the cross section of the receiving cavity 10*a* is a regular hexagon. FIG. 30(*a*) illustrates a structure of the support section 11 and the bent sections 12 before the support section 11 is bent. As shown in FIG. 30(*a*), each of the incomplete receiving cavities 10*a*' lacks one side wall. After the support section 11 is bent about the bent edge, referring to the dotted line and the arrow of FIG. 30(*a*), the support section 11 is divided into two parts (two bent surfaces) based upon the bent edge. The two parts of the support section 11 respectively form one side wall of each of the two receiving cavities 10*a*, as shown in FIG. 30(*b*).

It shall be understood that the aforementioned manner is suitable for another middle cases 10 of which the shapes of the cross sections of the receiving cavities 10*a* are regular polygons besides the regular hexagon.

The third situation is that the support section is bent about the bent edge to form two side walls respectively pertaining to two adjacent receiving cavities 10*a* each of which is formed by a plurality of side walls, and one side wall of one of the two adjacent receiving cavities 10*a* is shared by the two adjacent receiving cavities 10*a*.

Figure 31:
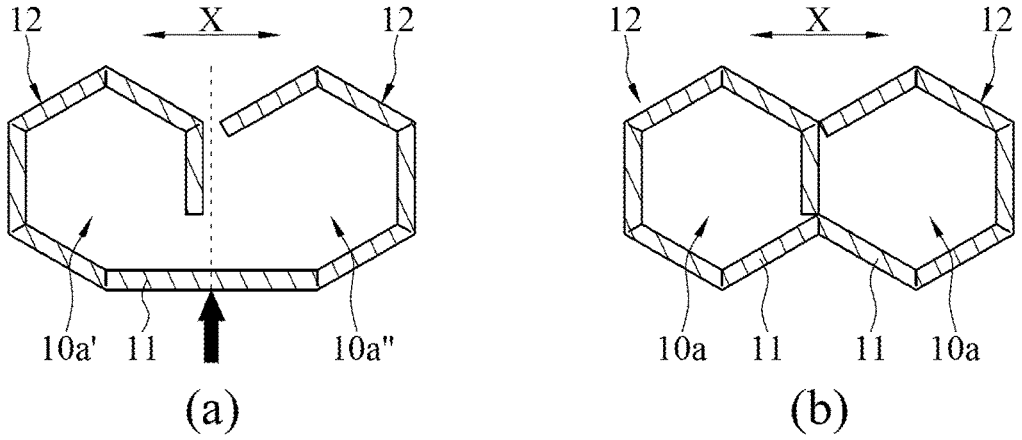

In the embodiment, as shown in FIG. 31, the shape of the cross section of the receiving cavity 10*a* is a regular hexagon. FIG. 31(*a*) illustrates a structure of the support section 11 and the bent sections 12 before the support section 11 is bent. As shown in FIG. 31(*a*), an incomplete receiving cavities 10*a*' lacks one side wall, and an incomplete receiving cavity 10*a*" lacks two side walls. After the support section 11 is bent about the bent edge, referring to the dotted line and the arrow of FIG. 31(*a*), the support section 11 is divided into two parts (two bent surfaces) based upon the bent edge. The two parts of the support section 11 respectively form one side wall of each of the two receiving cavities 10*a*, as shown in FIG. 31(*b*). Moreover, referring to FIG. 31(*a*) and FIG. 31(*b*), one side wall of the left receiving cavity 10*a* (the receiving cavity 10*a*') pertaining the left bent section 12 is shared by the right receiving cavity 10*a* (the receiving cavity 10*a*"). Eventually, both of the two receiving cavities 10*a* shown in FIG. 31(*b*) can wrap the tube lamps D completely.

It shall be understood that the aforementioned manner is suitable for another middle cases 10 of which the shapes of the cross sections of the receiving cavities 10*a* are regular polygons besides the regular hexagon.

Being analogous to the first embodiment, the bent sections 12 at two sides of the support section 11 of the second embodiment can be bent towards the same side of the support section 11 or can be bent towards different sides of the support section 11.

The Third Embodiment

The instant disclosure provides a third embodiment. The difference between the first embodiment and the third embodiment is that there are at least two layers of each of the side walls of the receiving cavity 10*a* of the third embodiment. More particularly, each of the receiving cavities 10*a* is formed by a plurality of side walls in the circumferential direction, and each of the side walls of the receiving cavity 10*a* has at least two layers in the radial direction (e.g., two or more side walls overlap one by one in the radial direction to form two or more layers). The inner layer of the side walls contacts the circumferential surface of the tube lamp D to have the tube lamp D tightly fit in the receiving cavity 10*a*.

Figure 32:
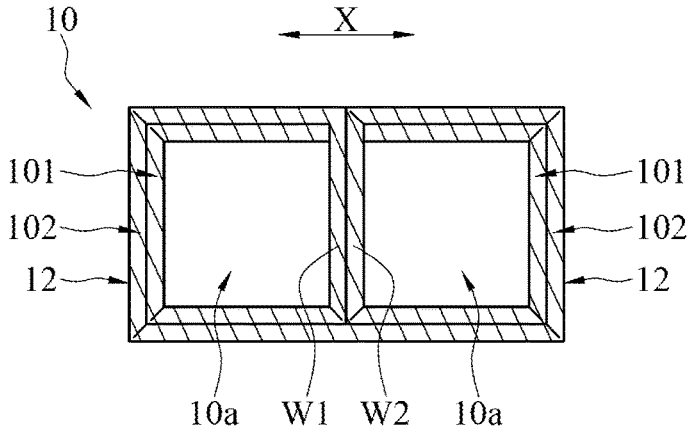
FIG. 32 illustrates a cross section of a middle case of a packing box according to the third embodiment of the instant disclosure.

In the embodiment, as shown in FIG. 32, the shape of the cross section of the receiving cavity 10*a* is a regular tetragon. Each of the receiving cavities 10*a* is formed by a plurality of double-layers side walls defined as a first layer 101 and a second layer 102 in the order from inside to outside in the radial direction. Each of the side walls of the first layer 101 can contact the circumferential surface of the tube lamp D (not shown) to have the tube lamp D tightly fit in the receiving cavity 10*a*.

Figure 33:
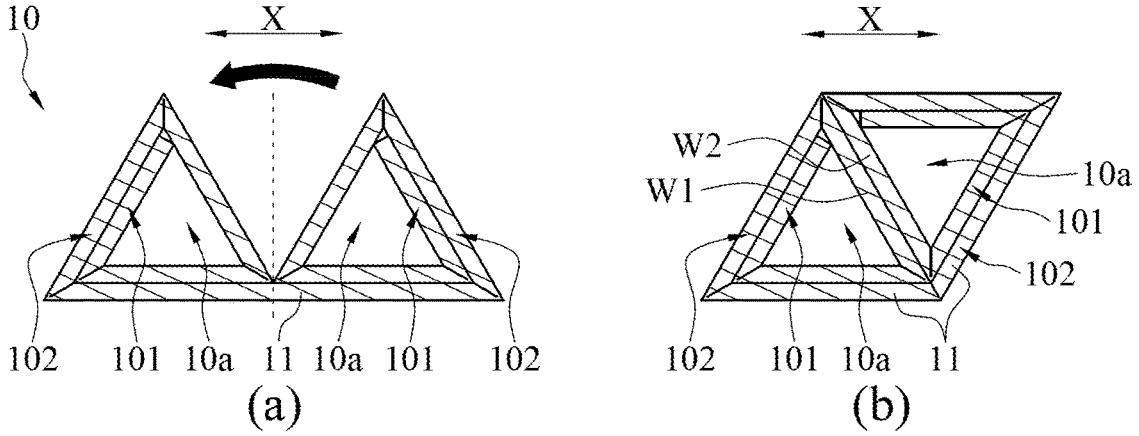
FIG. 33 to FIG. 35 illustrate cross sections of examples of two receiving cavities sharing side walls to form double-layers side walls according to the third embodiment of the instant disclosure.
Figure 34:
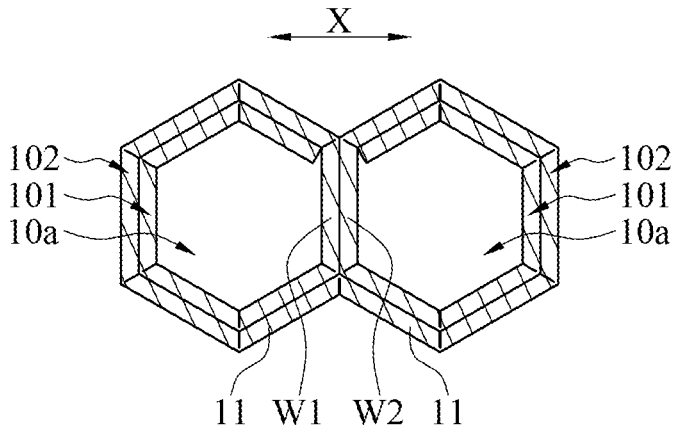

As described above, the shape of the cross section of the receiving cavity 10*a* of the third embodiment can be regular polygons besides the regular tetragon. For example, a regular triangle or a regular hexagon. As shown in FIG. 33, the shape of the cross section of the receiving cavity 10*a* formed by a plurality of double-layers side walls is a regular triangle. As shown in FIG. 34, the shape of the cross section of the receiving cavity 10*a* formed by a plurality of double-layers side walls is a regular hexagon.

Figure 35:
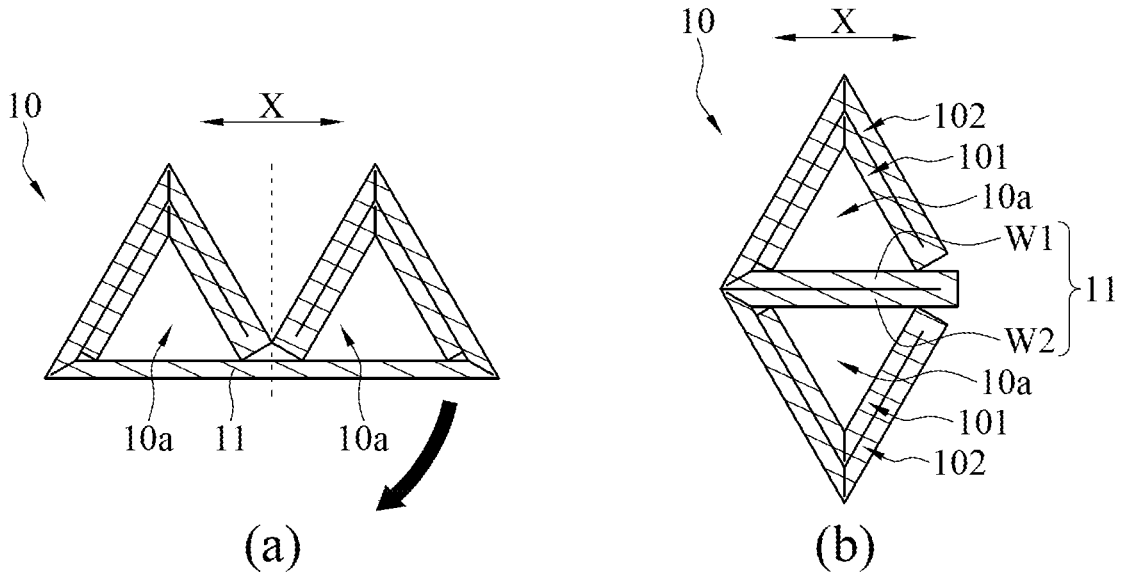
Figure 36:
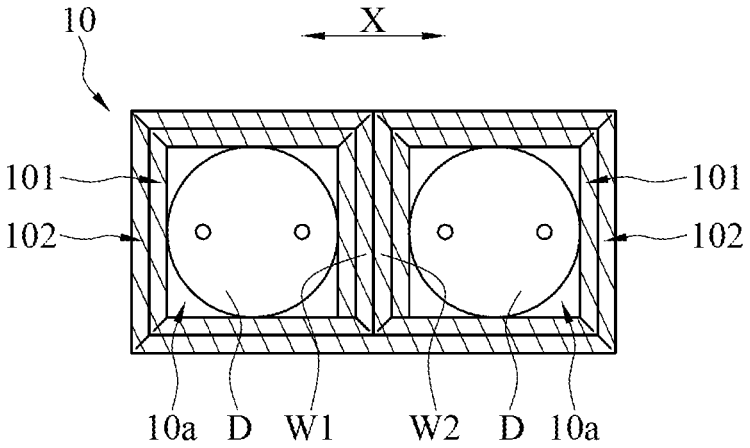
FIG. 36 and FIG. 37 illustrate cross sections of examples of two receiving cavities respectively having a double-layers side wall or a multi-layers side wall according to the third embodiment of the instant disclosure.

As shown in FIGS. 32, 33, 34, and 35, the number of the layers of each of the side walls of each of the receiving cavities 10*a* is two. As shown in FIG. 36, the number of the layers of each of the side walls of each of the receiving cavities 10*a* is two and more. It shall be understood that the number of the layers of each of the side walls of each of the receiving cavities 10*a* can be three or more, and the tube lamp D should be tightly fit in the space enclosed by the inner layer of the side walls (e.g., the first layer 101), no matter what the shape of the cross section of the receiving cavity 10*a* is.

Referring to FIG. 32, the middle case 10 comprises two adjacent receiving cavities 10*a*. One of the side walls forming one of the two adjacent receiving cavities 10*a* is defined as a first outer wall W1. One of the side walls forming the other one of the two adjacent receiving cavities 10*a* is defined as a second outer wall W2. The first outer wall W1 and the second outer wall W2 are attached to each other. The second outer wall W2 pertains to the second layer 102 of the side walls forming one of the receiving cavities 10*a* while the second outer wall W2 pertains to the first layer 101 of the side walls forming the other one of the receiving cavities 10*a*. The first outer wall W1 pertains to the first layer 101 of the side walls forming one of the receiving cavities 10*a* while the first outer wall W1 pertains to the second layer 102 of the side walls forming the other one of the receiving cavities 10*a*. More particularly, as shown in FIG. 32, the second outer wall W2 pertains to the second layer 102 of the side walls forming the left receiving cavity 10*a* while the second outer wall W2 pertains to the first layer 101 of the side walls forming the right receiving cavity 10*a*, and the first outer wall W1 pertains to the first layer 101 of the side walls forming the left receiving cavity 10*a* while the first outer wall W1 pertains to the second layer 102 of the side walls forming the right receiving cavity 10*a*. The first outer wall W1 and the second outer wall W2 form a double-layers side wall shared by the two receiving cavities 10*a*.

As shown in FIG. 32, the first outer wall W1 and the second outer wall W2 can respectively be the second layer 102 of each of the receiving cavities 10*a* to which the first outer wall W1 or the second outer wall W2 doesn't pertain. In other words, before the first outer wall W1 and the second outer wall W2 are attached to each other, two sides of the two receiving cavities 10*a* facing towards each other are single-layer side walls. After the first outer wall W1 and the second outer wall W2 are attached to each other, the first outer wall W1 and the second outer wall W2 are respectively the second layer 102 of each of the receiving cavities 10*a* to which the first outer wall W1 or the second outer wall W2 doesn't pertain.

It shall be understood that if one side of one of the two receiving cavities 10*a* facing towards the other one of the receiving cavities 10*a* is a single-layer side wall before the first outer wall W1 and the second outer wall W2 are attached to each other, the side which is initially the single-layer side wall can still function as a double-layers side wall after the first outer wall W1 and the second outer wall W2 are attached to each other. Thus one of the first outer wall W1 and the second outer wall W2 can be the second layer 102 of one of the receiving cavities 10*a* to which the other one of the first outer wall W1 and the second outer wall W2 pertains.

As shown in FIG. 32, the support section 11 is not bent, and the first outer wall W1 and the second outer wall W2 respectively pertain to the two bent sections 12 at two sides of the support section 11. The first outer wall W1 and the second outer wall W2 respectively pertain to the bent surface at a middle part of each of the bent sections 12.

As shown in FIG. 32, the first outer wall W1 and the second outer wall W2 are attached to each other by bending the bent sections 12 while the support section 11 is not bent.

In some embodiments, the support section 11 comprises a bent edge. The first outer wall W1 and the second outer wall W2 are attached to each other by bending the support section 11 about the bent edge. As shown in FIG. 33, the shape of the cross section of the receiving cavity 10*a* is a regular triangle. The support section 11 comprises a bent edge which can be referred to the dotted line in FIG. 33(*a*). As shown in FIG. 33(*a*), two sides of the two receiving cavities 10*a* facing towards each other are single-layer side walls before the support section 11 is bent. After the support section 11 is bent about the bent edge, referring to the dotted line and the arrow of FIG. 33(*a*), the two sides which are single-layer side walls overlap with each other such that the first outer wall W1 and the second outer wall W2 are attached to each other. As a result, as shown in FIG. 33(*b*), each side of each of the receiving cavities 10*a* is a double-layers side wall.

As shown in FIG. 34, the shape of the cross section of the receiving cavity 10*a* is a regular hexagon. The first outer wall W1 and the second outer wall W2 are attached to each other to form a double-layers side wall by bending the support section 11.

In some embodiments, the support section 11 comprises a bent edge. The first outer wall W1 and the second outer wall W2 are attached to each other by bending the support section 11 about the bent edge. Both of the first outer wall W1 and the second outer wall W2 pertain to the support section 11. As shown in FIG. 35(*a*), before the support section 11 is bent, both of the side of each of the receiving cavities 10*a* pertaining to the support section are single-layer side walls. After the support section 11 is bent about the bent edge, referring to the dotted line and the arrow of FIG. 35(*a*), the two sides which are single-layer side walls overlap with each other such that the first outer wall W1 and the second outer wall W2 are attached to each other. As a result, as shown in FIG. 35(*b*), each side of each of the receiving cavities 10*a* is a double-layers side wall.

Figure 37:
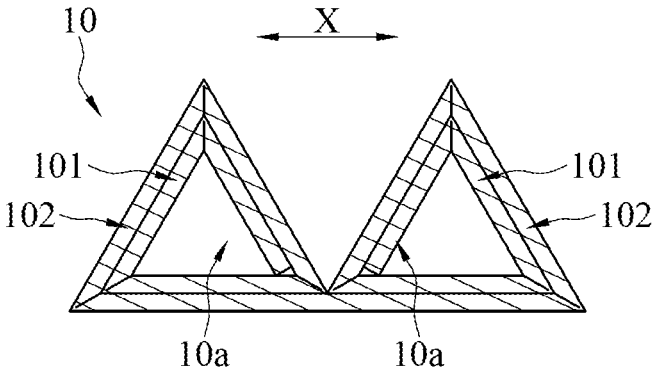

In some embodiments, as shown in FIG. 36 and FIG. 37, before the first outer wall W1 and the second outer wall W2 are attached to each other, each side of each of the receiving cavities 10*a* is a double-layers side wall already. According to the second embodiment, the alignment of the receiving cavities 10*a* can still be altered by bending the support section 11.

Under the circumstance that each side of each of the receiving cavities 10*a* is a double-layers side wall, the inner case 20 is optional. In other words, the protection for the tube lamp D is still enough without the inner case 20.

As shown in FIGS. 32, 33, and 34, each of the receiving cavities 10*a* is enclosed by the bent sections 12 and the support section 11. Each of the layers of the side walls forms a complete annular shape. The number of the bent surfaces of the bent section 12 is twice of the number of straight sides of the regular cavity 10*a* minus 2. For example, the number of straight sides of the regular polygon of the cross section of the receiving cavity 10*a* is n. n is natural number which is equal to or greater than 3. The number of the bent surfaces of the bent section 12 is equal to 2n−2. The two bent surfaces respectively pertaining to the two receiving cavities 10*a* and attached to each other (i.e., the first outer wall W1 and the second outer wall W2) are the $n^{th}$ bent surfaces from the last (the one at which the free end locates). The first outer wall W1 and the second outer wall W2 are the $(n-1)^{th}$ bent surfaces from the first (the one to which the support section 11 is connected). The $(n-1)^{th}$ bent surfaces from the first of each of the bent sections 12 are the first layers 101 respectively pertaining to the receiving cavities 10*a*.

As shown in FIG. 35, each of the receiving cavities 10*a* is enclosed by the bent sections 12 and the support section 11. Each of the layers of the side walls forms a complete annular shape. The number of the bent surfaces of the bent section 12 is the number of straight sides of the regular cavity 10*a* plus 1. For example, the number of straight sides of the regular polygon of the cross section of the receiving cavity 10*a* is n. n is natural number which is equal to or greater than 3. The number of the bent surfaces of the bent section 12 is equal to n+1. The two bent surfaces respectively pertaining to the two receiving cavities 10*a* and attached to each other (i.e., the first outer wall W1 and the second outer wall W2) pertain to support section 11 which is bent to be divided into two parts. The two parts are the first outer wall W1 and the second outer wall W2. After the support section 11 is bent about the bent edge, referring to the dotted line and the arrow of FIG. 35(*a*), the support section 11 is divided into two parts (the first outer wall W1 and the second outer wall W2) by the bent edge. As shown in FIG. 35(*b*), the first outer wall W1 pertains to the first layers 101 of the upside receiving cavity 10*a* and pertains to the second layer 102 of the downside receiving cavity 10*a*. On the other hand, the second outer wall W2 pertains to the first layers 101 of the downside receiving cavity 10*a* and pertains to the second layer 102 of the upside receiving cavity 10*a*.

It shall be understood that regarding the receiving cavity 10*a* formed by multi-layers side walls, at least one of the layers may form an incomplete annular shape, i.e., a part of an annular shape. Under the circumstance, the aforementioned rules with respect to the numbers and the orders of the bent surfaces respectively which pertain to the two receiving cavities 10*a* and are attached to each other are not applied.

The Fourth Embodiment

Figure 38:
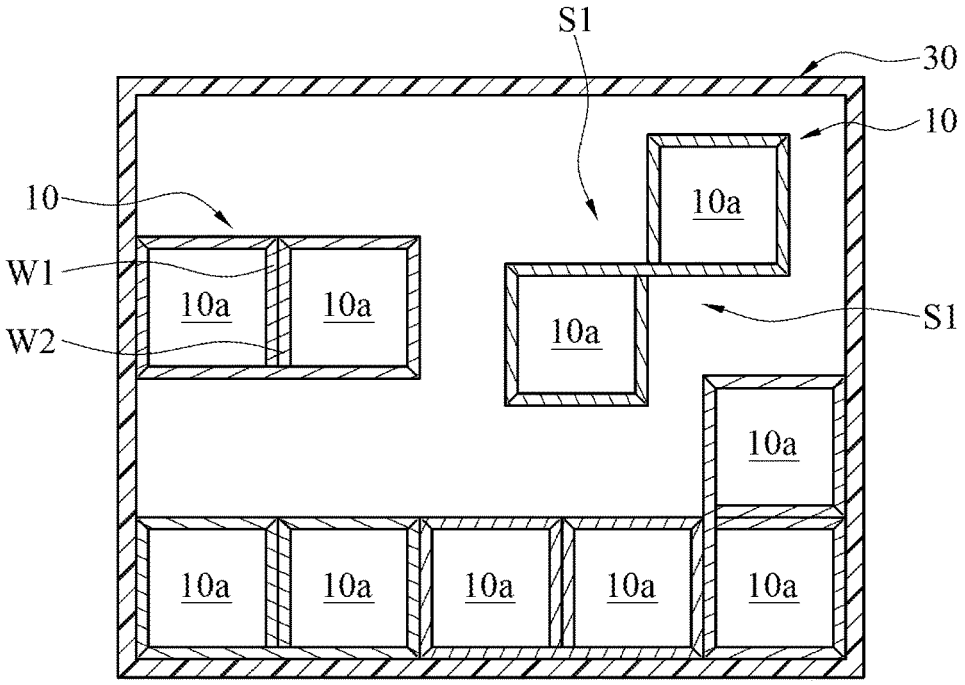
FIG. 38 illustrates a cross section of middle cases of which the shape of a cross section of each of receiving cavities is a regular tetragon being piled up in an outer case according to the fourth embodiment of the instant disclosure.

The instant disclosure provides a fourth embodiment. As shown in FIG. 38, the packing box further comprises an outer case 30. The outer case 30 can receive at least two middle cases 10.

The middle case 10 can be any types illustrated in the first, the second, and the third embodiments. After the middle cases 10 are piled up in the outer case 30, two side walls respectively forming each two of adjacent receiving cavities 10*a* respectively pertaining to each two of adjacent middle cases 10 are attached to each other (but are not fixed to each other); therefore, the number of the middle cases 10 that the outer case 30 can receive can be increased.

In the embodiment, the receiving cavities 10*a* of the middle cases 10 being piled up in the outer case 30 have the same structures. As shown in FIG. 38, the shape of the cross section of each of the receiving cavities 10*a* is a regular tetragon. After the middle cases 10 are piled up in the outer case 30, the receiving cavities 10*a* are substantially aligned as a matrix. Any of two side walls respectively forming each two of adjacent receiving cavities 10*a* respectively pertaining to each two of adjacent middle cases 10 are attached to each other.

In order to maximize the number of the middle cases 10 that the outer case 30 can receive, to minimize gaps between the middle cases 10, and to avoid the waste of space of the outer case 30 for receiving middle cases 10, two side walls respectively forming two adjacent receiving cavities 10*a* of at least one middle case 10 should be attached to each other. As shown in FIG. 38, one of the receiving cavities 10*a* of one of the middle cases 10 comprises the first outer wall W1, and the other one of the receiving cavities 10*a* of the same middle case 10 comprises the second outer wall W2. The first outer wall W1 and the second outer wall W2 of the middle case 10 are attached to each other.

The way how the first outer wall W1 and the second outer wall W2 are attached to each other can be referred to the third embodiment.

Additionally, regarding the middle cases 10 in the outer case 30, two adjacent receiving cavities 10*a* of at least one middle case 10 are substantially aligned diagonally. As shown in FIG. 38, two adjacent receiving cavities 10*a* of one of the middle case 10 are substantially aligned diagonally. Each one of the side walls of the middle case 10 of which the two adjacent receiving cavities 10*a* are substantially aligned diagonally is not attached to the other one of the side walls. Instead, the two adjacent receiving cavities 10*a* being substantially aligned diagonally form one or more receiving space S1. One of the receiving cavities 10*a* of one of the middle cases 10 can be fit in one of the receiving space S1 of the other one of the middle cases 10.

The contour of the receiving space S1 matches the contour of the receiving cavity 10*a* of the middle case 10 fit in the receiving space S1; therefore, the receiving cavity 10*a* of the middle case 10 can be perfectly fit in the receiving space S1 of another middle case 10.

Figure 39:
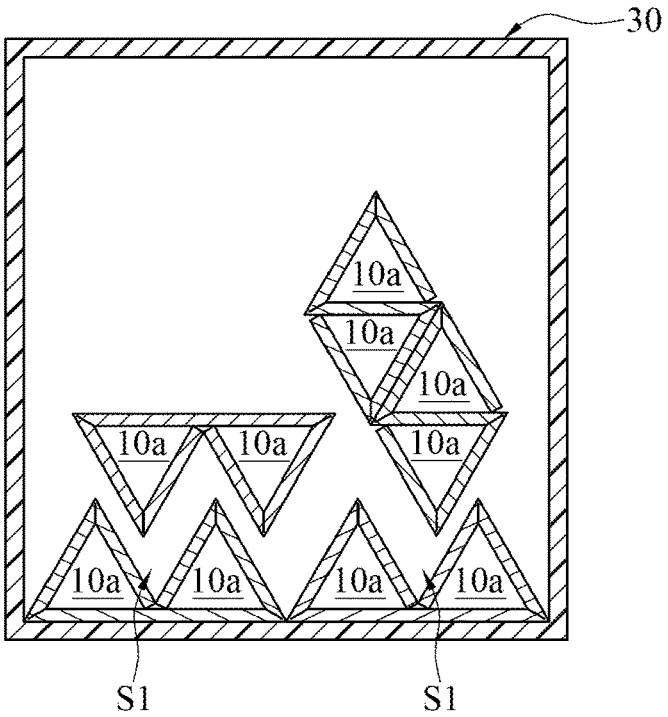
FIG. 39 illustrates a cross section of middle cases of which the shape of a cross section of each of receiving cavities is a regular triangle being piled up in an outer case according to the fourth embodiment of the instant disclosure.

As shown in FIG. 39, the shape of the cross section of each of the receiving cavities 10*a* is a regular triangle. Two side walls respectively forming two adjacent receiving cavities 10*a* of one of some the middle cases 10 in the outer case 30 of FIG. 39 are attached to each other. One receiving space S1 is formed between two adjacent receiving cavities 10*a* substantially aligned side by side of one of some middle cases 10 in the outer case 30 of FIG. 39. One of the receiving cavities 10*a* of one middle case 10 can be fit in the receiving space S1 of another middle case 10.

In order to maximize the number of the middle cases 10 that the outer case 30 can receive, to avoid the waste of space of the outer case 30 for receiving middle cases 10, and to have the middle cases 10 easily piled up, the alignments of the receiving cavities 10*a* of one of a part of the middle cases 10 can be different from those of the receiving cavities 10*a* of one of the other part of the middle cases 10.

Figure 40:
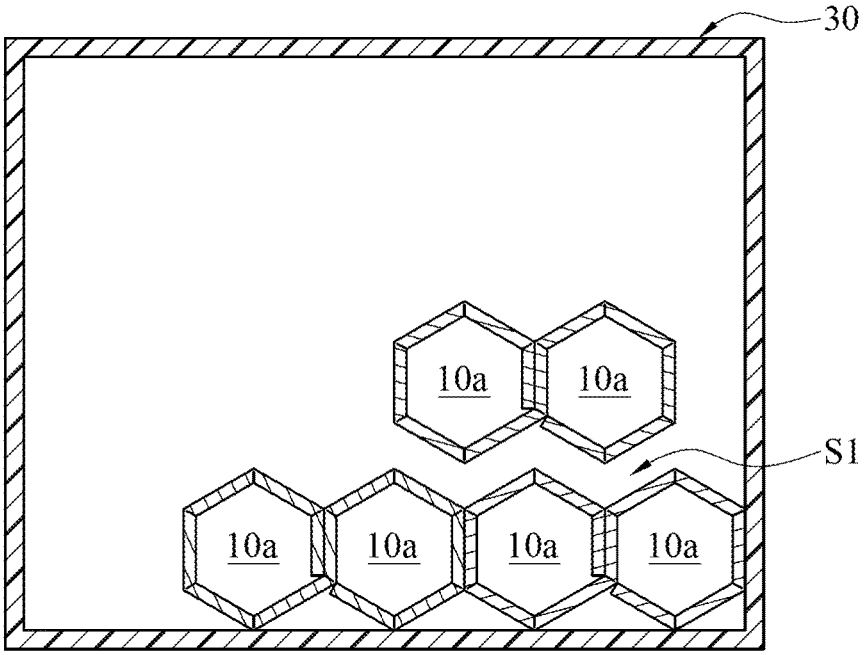
FIG. 40 illustrates a cross section of middle cases of which the shape of a cross section of each of receiving cavities is a regular hexagon being piled up in an outer case according to the fourth embodiment of the instant disclosure.

In some embodiments, the contour of the receiving space S1 matches a part of the contour of the receiving cavity 10*a* of the middle case 10 fit in the receiving space S1; therefore, a part of the receiving cavity 10*a* of the middle case 10 can be fit in the receiving space S1 of another middle case 10. As shown in FIG. 40, the shape of the cross section of each of the receiving cavities 10*a* is a regular hexagon. The contour of the receiving space S1 formed between two adjacent receiving cavities 10*a* of one middle case 10 matches a part of the contour of the receiving cavity 10*a* of another middle case 10. After the middle cases 10 are piled up, a part of the receiving cavity 10*a* of one of the middle cases 10 is fit in the receiving space S1 of another one of the middle cases 10.

The shape (the contour) of the outer case 30 can be designed based upon the shape (the contour) of the receiving cavities 10*a* of the middle cases 10. For example, the shape of the outer case 30 is identical to the shape of the receiving cavities 10*a* of the middle cases 10 to facilitate the pile of the middle cases 10.

Figure 41:
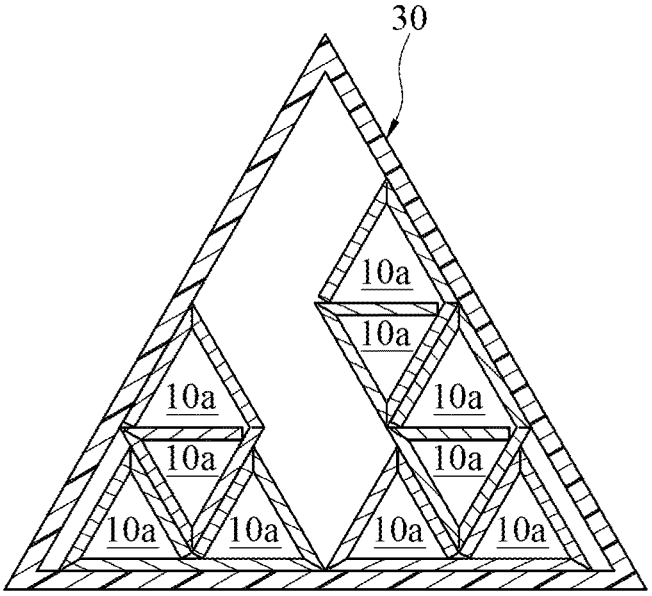
FIG. 41 illustrates a cross section of middle cases being piled up in an outer case according to the fourth embodiment of the instant disclosure, wherein both of the shapes of cross sections of each of receiving cavities and the outer case are regular triangles.

As shown in FIG. 41, the shape of the outer case 30 is regular triangle while the shape of the cross section of each of the receiving cavities 10*a* of each of the middle cases 10 is a regular triangle. If alignments of the receiving cavities 10*a* of the middle cases 10 are appropriate, and the middle cases 10 are properly piled up, the number of the middle cases 10 that the outer case 30 receives can be maximized.

Figure 42:
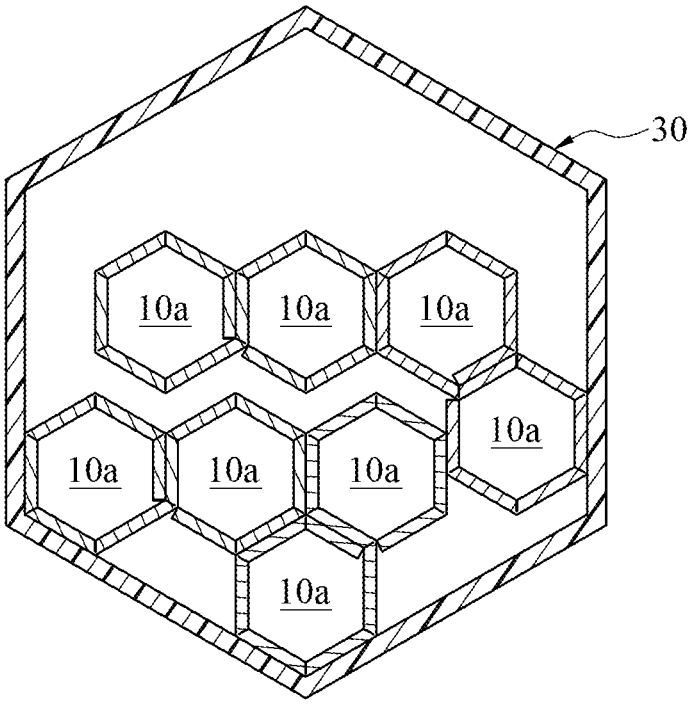
FIG. 42 and FIG. 43 illustrate cross sections of middle cases being piled up in an outer case according to the fourth embodiment of the instant disclosure, wherein both of the shapes of cross sections of each of receiving cavities and the outer case are regular hexagons.
Figure 43:
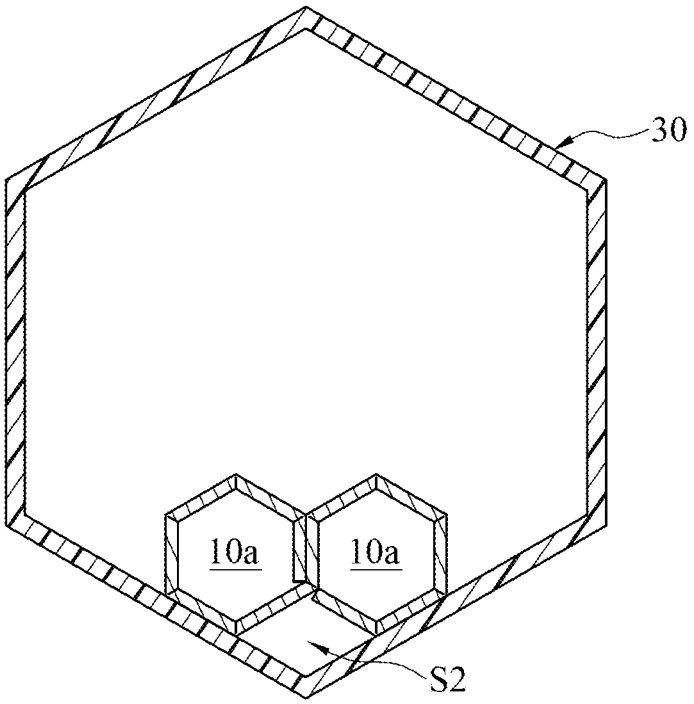

As shown in FIG. 42 and FIG. 43, the shape of the outer case 30 is regular hexagon while the shape of the cross section of each of the receiving cavities 10*a* of each of the middle cases 10 is a regular hexagon. If alignments of the receiving cavities 10*a* of the middle cases 10 are appropriate, and the middle cases 10 are properly piled up, the receiving cavities 10*a* of the middle cases 10 in the outer case 30 are honeycombed, and the number of the middle cases 10 that the outer case 30 receives can be maximized. The maximum number of the middle cases 10 that the outer case 30 can receive shown in FIG. 43 is less than that of the middle cases 10 that the outer case 30 can receive shown in FIG. 42. However, corners of the outer case 30 shown in FIG. 43 can be function as a buffer space S2 since there is a gap between at least one middle case 10 and walls of the outer case 30. When the corner of the outer case 30 is collided with something, a part of the force of impact can be absorbed by the corner having the buffer space S2 such that the force of impact won't directly completely transferred to the middle cases 10 in the outer case 30. Since the force of impact that the middle cases 10 and the tube lamps D in the middle cases 10 suffer is eased, the middle cases 10 and the tube lamps D won't be damaged easily.

Analogously, while the shape of the cross section of the receiving cavities 10*a* of the middle case 10 is a regular polygon besides the regular triangle, the regular tetragon, and the regular hexagon, the shape of the outer case 30 can be identical to the regular polygon accordingly. As shown in FIG. 38, FIG. 41, FIG. 42, and FIG. 43 the shape of the outer case 30 is identical to the shape of the cross section of the receiving cavities 10*a* of the middle case 10. Under the circumstance, 100% of the inner space of the outer case 30 can be utilized to receive the middle cases 10.

In different embodiments, the shapes of the cross sections of the receiving cavities 10*a* of different middle cases 10 can be different from each other. The middle cases 10 of which the shapes of the cross sections of the receiving cavities 10*a* are different from each other can be piled up in the same outer case 30.

While the instant disclosure has been described by way of example and in terms of the preferred embodiments, it is to be understood that the instant disclosure needs not be limited to the disclosed embodiments. For anyone skilled in the art, various modifications and improvements within the spirit of the instant disclosure are covered under the scope of the instant disclosure. The covered scope of the instant disclosure is based on the appended claims.

What is claimed is:

1. A packing box for packing tube lamps, comprising:

a middle case for packing at least two tube lamps, the middle case comprising:

a support section; and two bent sections at two opposite sides of the support section, the two bent sections being bent about bent edges respectively on the two bent sections towards the support section, wherein the support section and the two bent sections are substantially aligned in a width direction of the tube lamps before the bent sections are bent, and the support section and each of the two bent sections respectively form at least one receiving cavity for receiving one of the at least two tube lamps and are for wrapping the at least two tube lamps after the bent sections are bent, wherein, each of the receiving cavities is formed by a plurality of side walls, the middle case further comprises a connecting structure, the connecting structure comprises a male part and a female part, the male part and the female part are respectively on the side walls, and the male part is connected to the female part;

wherein, the male part is on an outer surface of the side wall of one of the receiving cavities, and the female part is on an outer surface of the side wall of another one of the receiving cavities;

wherein, the male part and the female part are respectively disposed on two of the bent edges of the two bent sections.

2. The packing box for packing tube lamps of claim 1, wherein each of the two bent sections comprises a free end, and at least one of the two bent sections are connected to the support section by the free end to form the receiving cavity for receiving the tube lamp and to be utilized for wrapping the tube lamp in a circumferential direction.

3. The packing box for packing tube lamps of claim 1, wherein the two bent sections at two opposite sides of the support section are bent towards the same side of the support section.

4. The packing box for packing tube lamps of claim 1, wherein the shape of a projection of the receiving cavity along a length direction substantially perpendicular to the width direction of the tube lamps is a regular polygon.

5. The packing box for packing tube lamps of claim 1, wherein the middle case further comprises at least one protective structure disposed in the receiving cavity for preventing the tube lamp in the receiving cavity from moving out, and the protective structure is for against an end of the tube lamp.

6. The packing box for packing tube lamps of claim 5, wherein the receiving cavity is defined as a receiving part and an extending part in a length direction substantially perpendicular to the width direction of the tube lamps, the receiving part is for receiving the tube lamp, and the protective structure is in the extending part.

7. The packing box for packing tube lamps of claim 6, wherein each of the receiving cavities is formed by a plurality of side walls comprising a first side wall and a second side wall adjacent to each other in a circumferential direction, the protective structure is formed on the first side wall and the second side wall, and the protective structure comprises:

two edges spaced from each other in the length direction, each of the two edges crossing the first side wall and the second side wall in the circumferential direction and being separated from the first side wall and the second side wall; and an inversely bent section between the two edges, the inversely bent section being bent towards the inner side of the receiving cavity.

8. The packing box for packing tube lamps of claim 7, wherein a first bent edge is formed between the first side wall and the second side wall, the inversely bent section comprises two bent surfaces, and a second bent edge is formed between the two bent surfaces, wherein, before the inversely bent section is bent, the first bent edge and the second bent edge are substantially aligned in the same straight line or the first bent edge and the second bent edge are spaced from each other in the width direction.

9. The packing box for packing tube lamps of claim 7, wherein the inversely bent section is spaced from an end edge of the extending part away from the receiving part of the receiving cavity.

10. The packing box for packing tube lamps of claim 9, wherein a length of the inversely bent section in the length direction is between 1 cm and 3 cm.

11. The packing box for packing tube lamps of claim 7, wherein one of the two edges of the protective structure overlaps an end edge of the extending part away from the receiving part of the receiving cavity.

12. The packing box for packing tube lamps of claim 11, wherein a length of the extending part of the receiving cavity in the length direction is between 10 cm and 20 cm.

13. The packing box for packing tube lamps of claim 7, wherein the number of the protective structures is two, one of the two protective structures is formed on two adjacent side walls, and the other one of the two protective structures is formed on another two adjacent side walls.

14. The packing box for packing tube lamps of claim 7, wherein the shape of a cross section of the protective structure enclosed by the inversely bent section, the first side wall, and the second side wall in a radial direction of the tube lamp is a tetragon, and the area of the cross section of the protective structure in the radial direction is from 1/16 to 9/16 of the area of a cross section of the receiving cavity in the radial direction.

15. The packing box for packing tube lamps of claim 1, wherein each of the two bent sections comprises a free end, the male part is on the free end, and the female part is on the support section.

16. The packing box for packing tube lamps of claim 1, wherein the connecting structure is a coupling structure or an adhesive structure.

17. The packing box for packing tube lamps of claim 1, wherein the support section comprises a bent edge along a length direction substantially perpendicular to the width direction of the tube lamps, and the support section is capable of being bent about the bent edge.

18. The packing box for packing tube lamps of claim 17, wherein the support section is bent about the bent edge to form two side walls attached to each other and respectively pertaining to two adjacent receiving cavities each of which is formed by a plurality of side walls.

19. The packing box for packing tube lamps of claim 17, wherein the support section is bent about the bent edge to form one side wall shared by two adjacent receiving cavities each of which is formed by a plurality of side walls.

20. The packing box for packing tube lamps of claim 17, wherein the support section is bent about the bent edge to form two side walls respectively pertaining to two adjacent receiving cavities each of which is formed by a plurality of side walls.

21. The packing box for packing tube lamps of claim 17, wherein each of the two bent sections comprises a free end, and at least one of the two bent sections are connected to the support section by the free end to form the receiving cavity for receiving the tube lamp and to be utilized for wrapping the tube lamp in a circumferential direction.

22. The packing box for packing tube lamps of claim 17, wherein the two bent sections at two opposite sides of the support section are bent towards the same side of the support section.

23. The packing box for packing tube lamps of claim 17, wherein the middle case further comprises at least one protective structure disposed in the receiving cavity for preventing the tube lamp in the receiving cavity from moving out, and the protective structure is for against an end of the tube lamp.

24. The packing box for packing tube lamps of claim 23, wherein the receiving cavity is defined as a receiving part and an extending part in the length direction, the receiving part is for receiving the tube lamp, and the protective structure is in the extending part.

25. The packing box for packing tube lamps of claim 24, wherein each of the receiving cavities is formed by a plurality of side walls comprising a first side wall and a second side wall adjacent to each other in a circumferential direction, the protective structure is formed on the first side wall and the second side wall, and the protective structure comprises:

two edges spaced from each other in the length direction, each of the two edges crossing the first side wall and the second side wall in the circumferential direction and being separated from the first side wall and the second side wall; and an inversely bent section between the two edges, the inversely bent section being bent towards the inner side of the receiving cavity.

26. The packing box for packing tube lamps of claim 25, wherein a first bent edge is formed between the first side wall and the second side wall, the inversely bent section comprises two bent surfaces, and a second bent edge is formed between the two bent surfaces, wherein, before the inversely bent section is bent, the first bent edge and the second bent edge are substantially aligned in the same straight line or the first bent edge and the second bent edge are spaced from each other in the width direction.

27. The packing box for packing tube lamps of claim 17, wherein each of the receiving cavities is formed by a plurality of side walls, the middle case further comprises a connecting structure, the connecting structure comprises a male part and a female part, the male part and the female part are respectively on the side walls, and the male part is connected to the female part.

28. The packing box for packing tube lamps of claim 17, wherein the male part is on an outer surface of the side wall of one of the receiving cavities, and the female part is on an outer surface of the side wall of another one of the receiving cavities.

29. A packing box for packing tube lamps, comprising:

a middle case for packing tube lamps, the middle case comprising:

a support section; and two bent sections at two opposite sides of the support section, the two bent sections being bent towards the support section, wherein the support section and the two bent sections are substantially aligned in a width direction of the tube lamps before the bent sections are bent, wherein the support section and each of the two bent sections respectively form a plurality of receiving cavities of which the number is even, each of the plurality of the receiving cavities is for receiving one of the tube lamps, and the support section and each of the two bent sections are for wrapping the tube lamps after the bent sections are bent, wherein each of the receiving cavities is formed by a plurality of side walls, the middle case further comprises a connecting structure, the connecting structure comprises a male part and a female part, the male part and the female part are respectively on the side walls, and the male part is connected to the female part; wherein, the male part is on an outer surface of the side wall of one of the receiving cavities, and the female part is on an outer surface of the side wall of another one of the receiving cavities, and wherein the two bent sections are bent about bent edges respectively on the two bent sections towards the support section, and the male part and the female part are respectively disposed on two of the bent edges of the two bent sections.

30. The packing box for packing tube lamps of claim 29, wherein the even number of the plurality of the receiving cavities is 2, 4, 8 or 16.

31. The packing box for packing tube lamps of claim 29, wherein the middle case further comprises at least one protective structure disposed in at least one of the receiving cavities for preventing the tube lamp in the receiving cavity from moving out, and the protective structure is for against an end of the tube lamp; wherein each of the receiving cavities is formed by a plurality of side walls comprising a first side wall and a second side wall adjacent to each other in a circumferential direction, the protective structure is formed on the first side wall and the second side wall, and the protective structure comprises:

two edges spaced from each other in a length direction perpendicular to the width direction of the tube lamps, each of the two edges crossing the first side wall and the second side wall in the circumferential direction and being separated from the first side wall and the second side wall; and an inversely bent section between the two edges, the inversely bent section being bent towards the inner side of the receiving cavity;

wherein a first bent edge is formed between the first side wall and the second side wall, the inversely bent section comprises two bent surfaces, and a second bent edge is formed between the two bent surfaces, wherein, before the inversely bent section is bent, the first bent edge and the second bent edge are spaced from each other in the width direction.

* * * * *